US007987617B2

(12) United States Patent
Kohatsu et al.

(10) Patent No.: US 7,987,617 B2
(45) Date of Patent: Aug. 2, 2011

(54) SELF ASSEMBLED ARTICLE OF FOOTWEAR WITH CUSTOMIZED DESIGNS

(75) Inventors: Shane S. Kohatsu, Portland, OR (US); Daniel W. Peter, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 931 days.

(21) Appl. No.: 11/939,058

(22) Filed: Nov. 13, 2007

(65) Prior Publication Data

US 2009/0119950 A1 May 14, 2009

(51) Int. Cl.
*A43B 3/24* (2006.01)

(52) U.S. Cl. ..... 36/1; 36/100; 36/101; 36/15

(58) Field of Classification Search ..... 36/1, 15, 36/11, 100, 101, 136
See application file for complete search history.

(56) References Cited

U.S. PATENT DOCUMENTS

| | | | | |
|---|---|---|---|---|
| 871,187 | A | 11/1907 | Saunders | |
| D138,028 | S | 6/1944 | Hinson | |
| D143,457 | S | 1/1946 | Williams | |
| 2,438,711 | A | 3/1948 | Leach et al. | |
| D154,507 | S | 7/1949 | Page | |
| 2,630,636 | A * | 3/1953 | Cockrell | 36/11 |
| D169,956 | S | 7/1953 | Baroumes | |
| 3,676,883 | A | 7/1972 | Peacock | |
| 3,742,625 | A | 7/1973 | Famolare, Jr. | |
| 4,023,283 | A | 5/1977 | Pfander | |
| 4,685,223 | A * | 8/1987 | Long | 36/16 |
| 5,575,087 | A * | 11/1996 | Ehrhart et al. | 36/11 |
| 6,299,962 | B1 | 10/2001 | Davis et al. | |
| 6,353,770 | B1 | 3/2002 | Ramsey et al. | |
| 6,516,240 | B2 | 2/2003 | Ramsey et al. | |
| 6,874,256 | B2 * | 4/2005 | Delgatty | 36/100 |
| 7,107,235 | B2 | 9/2006 | Lyden | |
| 7,171,768 | B2 | 2/2007 | Klein | |
| 7,219,443 | B2 | 5/2007 | Czaplewski et al. | |
| 7,272,897 | B2 * | 9/2007 | Yu | 36/11.5 |
| 2005/0071242 | A1 | 3/2005 | Allen et al. | |
| 2005/0131571 | A1 | 6/2005 | Costin | |
| 2005/0289018 | A1 | 12/2005 | Sullivan et al. | |
| 2006/0213088 | A1 | 9/2006 | Grove et al. | |
| 2007/0039209 | A1 | 2/2007 | White et al. | |
| 2007/0113388 | A1 | 5/2007 | Harrison | |
| 2007/0199210 | A1 | 8/2007 | Vattes et al. | |
| 2008/0147219 | A1 | 6/2008 | Jones et al. | |

FOREIGN PATENT DOCUMENTS

| | | |
|---|---|---|
| FR | 2 577 393 | 8/1986 |
| GB | 2 068 211 | 8/1981 |

OTHER PUBLICATIONS

International Search Report and Written Opinion, mailed Feb. 6, 2009, from PCT Application No. PCT/US2008/083183.

F Troupe: Make a moccasin kit; Qeeper (A forum for product finders) Nov. 10, 2007, figure 1; abstract; [retrieved Jan. 29, 2009]. Retrieved from the Internet.
<URL:http://qeeper.com/2007/11/10/f-troupe-make-a-mocasin-kit/.

International Preliminary Report on Patentability mailed May 27, 2010 in PCT Application No. PCT/US2008/083183.

* cited by examiner

*Primary Examiner* — Marie Patterson
(74) *Attorney, Agent, or Firm* — Plumsea Law Group, LLC

(57) ABSTRACT

A method of customizing an article of footwear that is configured for self assembly is disclosed. The method includes steps of applying customized designs to pre-cut portions, and packaging the pre-cut portions with a lace and a set of instructions into a kit of parts. The kit of parts can be taken home and assembled by the customer.

28 Claims, 18 Drawing Sheets

SELF ASSEMBLED ARTICLE OF FOOTWEAR WITH CUSTOMIZED DESIGNS

BACKGROUND OF THE INVENTION

1. Field of the Invention

The present invention relates generally to footwear and in particular to a method of customizing an article of footwear configured for self assembly.

2. Description of Related Art

Customization systems for some types of apparel have been previously proposed. Usually, designs may be applied to t-shirts. In some cases, apparel such as jeans may be modified and custom designed. Sometimes, the system through which the customer designs and orders the apparel may be the Internet. One example of such a system is disclosed in co-pending and commonly-owned U.S. application Ser. No. 11/612,320, filed on Dec. 18, 2006, and entitled "A Method of Making an Article of Footwear," hereby referred to as "the customization case", which is incorporated by reference herein in its entirety.

Sullivan (U.S. patent number 2005/0289018) discloses an online personal apparel design and sales technology with fulfillment techniques and processes. Sullivan teaches methods for customized and personalized design of apparel. The most common type of apparel taught by Sullivan includes various types of shirts and t-shirts. Generally, Sullivan teaches a system for customization, but does not disclose detailed processes by which the customized apparel is produced.

Costin (U.S. patent number 2005/0131571) teaches an Internet based technique for customization of apparel. Specifically, Costin teaches customization of denim apparel over the Internet. Costin uses a laser device that etches designs and patterns into denim apparel. Generally, techniques of applying intricate images and graphics involving multiple colors are not disclosed.

Allen et al. (U.S. patent number 2005/0071242) discloses a method and system for custom-manufacturing footwear. This system and method may allow a retailer to control the selection of choices given to the customer for custom-manufacturing the footwear. In the method of Allen, the designs of the article of footwear are pre-determined by the manufacturer, allowing the user the option of selecting between designs and in some cases, various colors for the designs. Generally, however, the method of Allen lacks provisions for allowing a full range of graphical designs and modifications to customize an article of footwear. There is no feature, for example, that allows a user to add a customized image of their choosing to an article of footwear.

Articles of footwear that may be designed by printing along a two-dimensional portion of an article of footwear have also been proposed. Davis et al. (U.S. Pat. No. 6,299,962) teaches an invention directed to an article of footwear and a method of making the same, where the article of footwear has a minimum number of upper pieces. In the method of Davis, the outer layer of the upper is molded using an embossing tool. Additionally, the outer layer may be decorated by screen printing, sublimation, large format in jet printing, cold and hot peel transfers, as well as other means. Generally, however, the method of Davis is limited to printing only a single portion of an upper.

While the related art teaches various methods for customizing apparel, there are many shortcomings. Generally, the automated methods used for producing customized apparel based on customized designs lack provisions for applying customized designs to objects with curved surfaces. Specifically, the methods used for producing customized t-shirts, which are themselves flat and two-dimensional, are not appropriate for articles of footwear that include many curved surfaces.

Additionally, the articles of footwear disclosed in the prior art lack customization and variability in the footwear portions that may be modified using a printer or other similar devices. There is therefore a need in the art for a customization system directed at articles of footwear including steps for customizing the article of footwear as well as steps for manufacturing the customized article of footwear.

Articles of footwear configured for self assembly have also been disclosed. Juveneton (French patent number 2,577,393) teaches a method for manufacturing a shoe from fabric in "ready-to-assemble" form for do it yourself construction. The shoe consists of fabric on which the pattern of the pair of shoes is traced. The patterns are then cut and the corresponding pieces are assembled by means of zigzag stitching.

Famolare (U.S. Pat. No. 3,742,625) is directed to an articulated clog. Famolare teaches an articulated clog construction which may be assembled by an unskilled person using only a simple tool, such as a hammer. The clog is comprised of three injection molded, hollow, rib reinforced plastic body elements. A one piece, contoured, flexible insole is attached by pins, rivets or nails to the body elements. Three sole elements are attached by pin-like projections to the body elements.

Although Juveneton and Famolare both teach articles of footwear that may be self assembled, they lack teachings of self customized portions. There is a need in the art for a system that solves this problem as well as the other problems of the prior art.

SUMMARY OF THE INVENTION

A method of customizing an article of footwear that is configured for self assembly is disclosed. In one aspect, the invention provides a method of customizing an article of footwear, comprising the steps of: providing a graphical interface system for designing a footwear representation; receiving a design including a footwear representation with a customized design; applying a customized design to a pre-cut portion according to the footwear representation; and providing a kit including the pre-cut portion, a lace, and a set of instructions for assembling the article of footwear.

In another aspect, the graphical interface system is provided on a computer at a retail store or kiosk.

In another aspect, the customized design is digitally printed to the pre-cut portion.

In another aspect, the customized design is stitched onto the pre-cut portion.

In another aspect, the invention provides a kit of parts, comprising: a first pre-cut portion and a second pre-cut portion, the first pre-cut portion including a customized design; a lace; a set of instructions; and wherein the first pre-cut portion and the second pre-cut portion may be attached using the lace to form an assembled article of footwear according to the set of instructions and where the lace may be used to adjustably fasten the assembled article of footwear.

In another aspect, the kit of parts includes four pre-cut portions.

In another aspect, the kit of parts includes a lateral side portion.

In another aspect, the kit of parts includes a medial side portion.

In another aspect, the kit of parts includes a bottom portion.

In another aspect, the kit of parts includes a tongue portion.

In another aspect, the lace includes a first end portion and a second end portion that are used to adjustably tighten the assembled article of footwear between an open position and a closed position.

In another aspect, the lace includes an intermediate portion that is disposed between the first end portion and the second end portion and where the intermediate portion is used to attach the first pre-cut portion to the second pre-cut portion.

In another aspect, the second pre-cut portion includes a customized design.

In another aspect, the invention provides an article of footwear, comprising: a first pre-cut portion and a second pre-cut portion; a lace including a first end portion, a second end portion and an intermediate portion that is disposed between the first end portion and the second end portion; the intermediate portion being used to attach the first pre-cut portion to the second pre-cut portion; and where the first end portion and the second end portion are used to adjustably tighten the article of footwear between an open position and a closed position.

In another aspect, the first end portion and the second end portion are associated with a set of lacing holes.

In another aspect, the lacing holes are disposed on a vamp portion of the article of footwear.

In another aspect, the peripheries of the first pre-cut portion and the second pre-cut portion include holes.

In another aspect, the intermediate portion is disposed through the holes.

In another aspect, the first pre-cut portion is stitched to the second pre-cut portion using the intermediate portion.

In another aspect, the invention provides an article of footwear, comprising: a pre-cut portion and a sole portion including at least one flap; a lace including a first end portion, a second end portion and an intermediate portion that is disposed between the first end portion and the second end portion; the intermediate portion being used to attach the pre-cut portion to sole portion; and where the lace is disposed through at least one hole in the at least one flap.

In another aspect, the sole portion includes a side flap.

In another aspect, the sole portion includes a front flap and a rear flap.

In another aspect, the lace is associated with a lace lock that is configured to prevent the first end portion from slipping through a lacing hole.

In another aspect, a liner is disposed over the sole portion.

Other systems, methods, features and advantages of the invention will be, or will become apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention. Moreover, in the figures, like reference numerals designate corresponding parts throughout the different views.

DETAILED DESCRIPTION OF THE PREFERRED EMBODIMENTS

Figure 1:
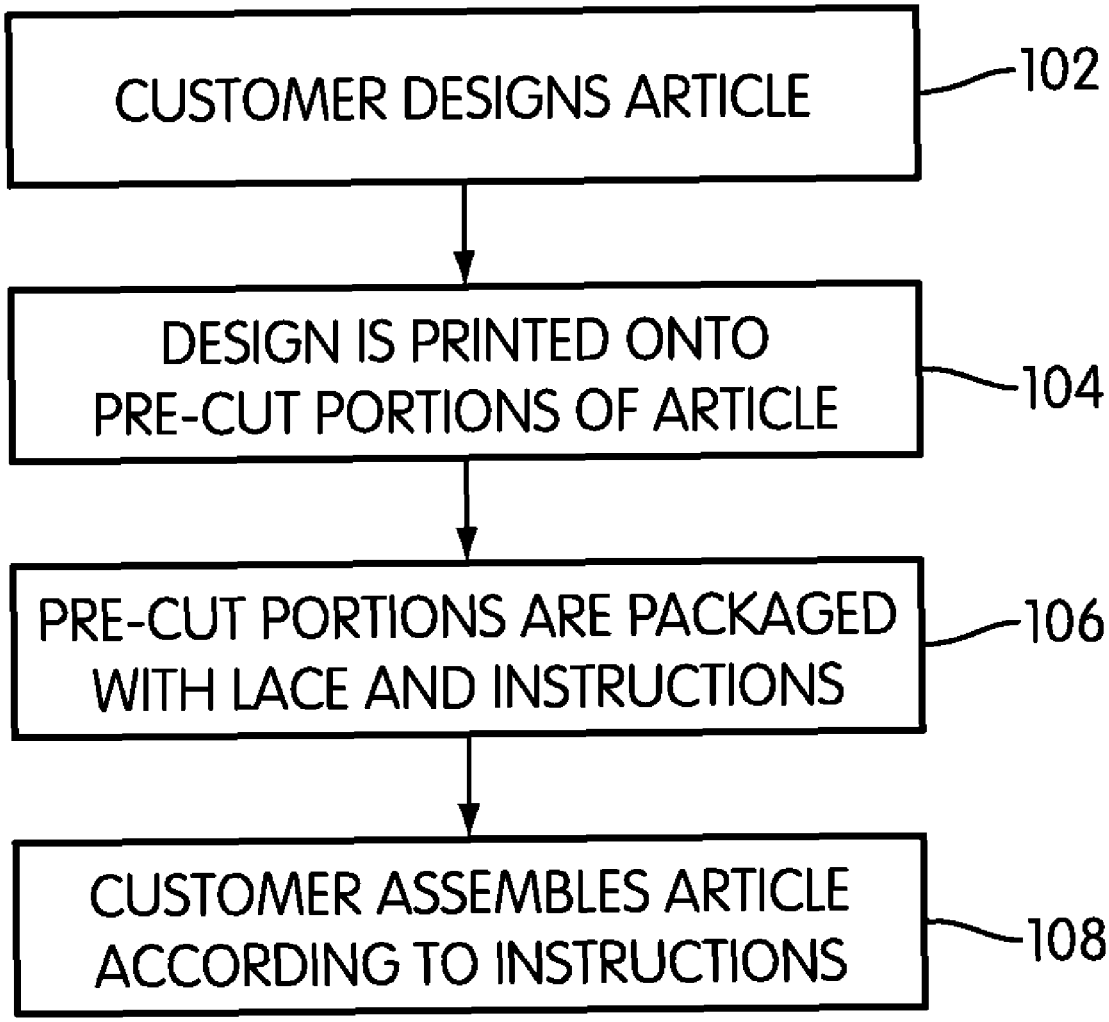
FIG. 1 is a preferred embodiment of a process for making a self assembled article of footwear with customized designs.

FIG. 1 is a preferred embodiment of a process for making a self assembled article of footwear with customized designs. The term "self assembled", as used throughout the remainder of this detailed description and in the claims, refers to any article of footwear that can be assembled by a customer, as opposed to a retailer or manufacturer. Additionally, the term "customized design" as used throughout this detailed description and in the claims refers to any design that is associated with an article of footwear by a customer.

During a first step 102, a customer may design an article of footwear using a customization system of some kind. Provisions for customizing an article of footwear have been previously disclosed in the customization case. Once a customer has customized an article of footwear, the design may be printed to one or more pre-cut portions of the article of footwear, during a second step 104.

Following this, during a third step 106, the pre-cut portions of the article of footwear may be packaged together in a kit. The kit may also include a lace that is used to assemble the pre-cut portions. Additionally, the kit may include a set of instructions that provide directions for self assembly. Finally, during a fourth step 108, the customer may receive the kit. At this point, the customer may assemble the pre-cut portions and the lace into an article of footwear using the set of instructions.

Figure 2:
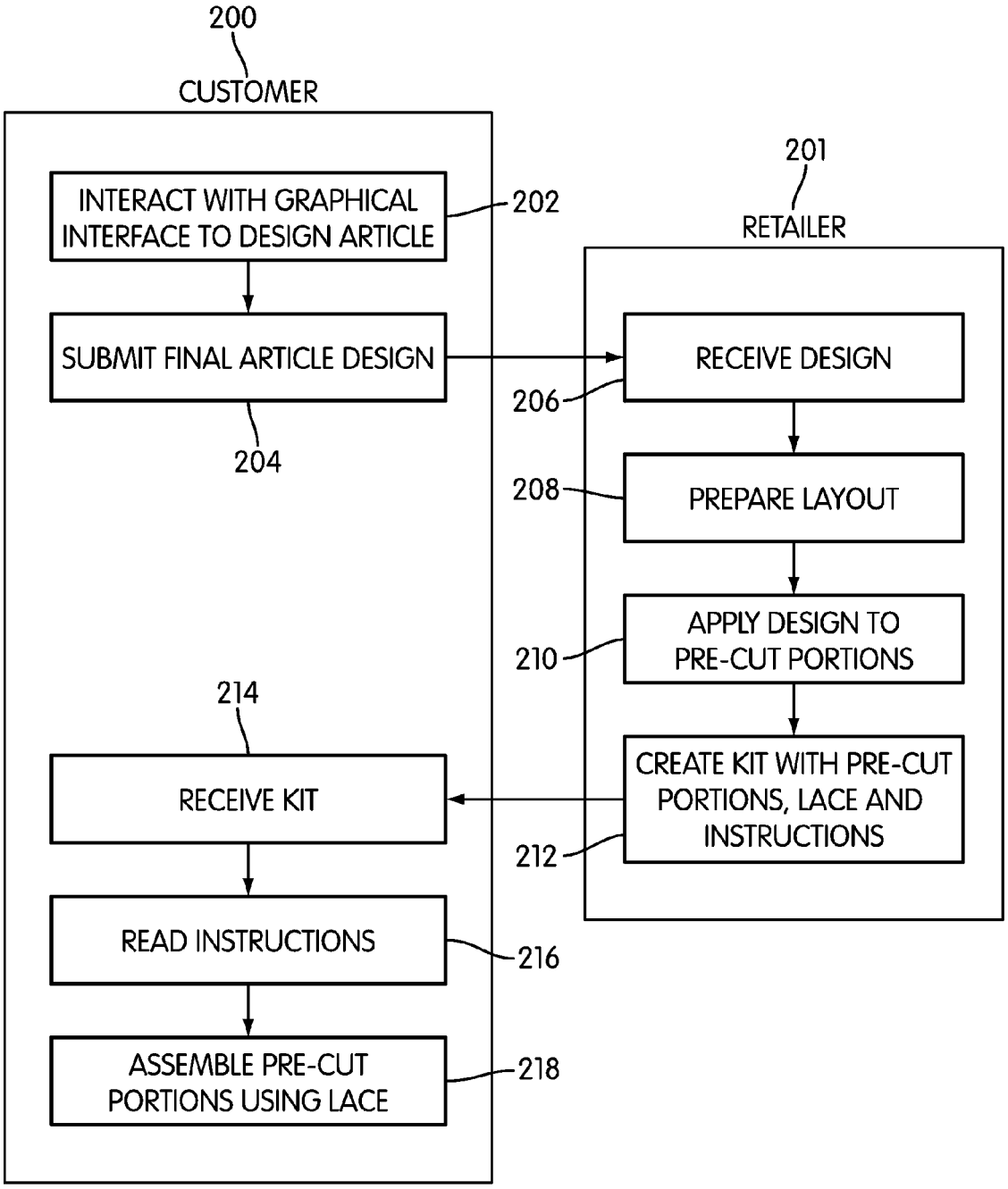
FIG. 2 is a preferred embodiment of a process including steps performed by a customer and steps performed by a retailer for making a self assembled article of footwear with customized designs.

Referring to FIG. 2, the process of making articles of footwear that include customized designs for self assembly may be best understood by separating the steps associated with a customer and those associated with the retailer. In the current embodiment, customer 200 may access a graphical interface system to design an article of footwear during a first step 202. In some embodiments, the graphical interface system may be a graphical editor of some kind. In a preferred embodiment, the graphical interface system may provide a set of tools that allow customer 200 to easily apply a customized design to an article of footwear. In some cases, customer 200 can access the graphical interface system by accessing a website on the Internet, as disclosed in the customization case. In other cases, customer 200 could travel to a retail store that includes a kiosk or computer configured to allow customers access to a graphical interface system of some kind.

Although the preferred embodiment includes the use of a graphical interface system, in other embodiments customer 200 could design portions of the article of footwear without the use of a graphical interface system. Instead, customer 200 may use a form to select pre-existing designs to be applied to one or more pre-selected portions of an article of footwear. Generally, during step 202, customer 200 could use any provisions for associating customized designs with one or more portions of an article of footwear.

During a second step 204, once customer 200 selects a finalized customized design for the article of footwear, the final article design may be submitted. In some embodiments, this could be accomplished by pressing a "submit" button associated with the graphical interface system. In other embodiments, customer 200 could mail in, or otherwise submit, a form to retailer 201.

Preferably, once the final article design has been submitted, the design may be received by retailer 201 during a third step 206. Generally, retailer 201 may be anyone configured to make and/or sell articles of footwear. In some cases, retailer 201 may be associated with a retail store. In other cases, retailer 201 may be associated with a kiosk in a mall. In still other cases, retailer 201 may be associated with one or more manufacturing locations. In such cases, customer 200 may not travel directly to retailer 201, but instead may send the final article design to retailer 201 through the mail or Internet, and may receive articles of footwear from retailer 201 through the mail.

Once retailer 201 has received the final article design, retailer 201 may prepare a design layout for an article of footwear, during fourth step 208. At this point, the customized design prepared by customer 200 may be associated with one or more portions of an article of footwear. In some embodiments, this step may be performed by a computer, as previously disclosed. In other embodiments, the layout may be manually prepared by a worker.

Preferably, during a fifth step 210, the customized design may be applied to one or more pre-cut portions associated with the article of footwear. In the customization case, a single material was printed with a customized design and then individual portions were cut to form an assembled article of footwear. However, in the current embodiment, the portions associated with the article of footwear may be pre-cut prior to customization and printing. In other words, retailer 201 may have access to a set of pre-cut portions that have been manufactured at an earlier time.

Generally, any method for applying designs to various materials could be used. In some cases, the customized design may be printed to one or more portions of an article of footwear. In other cases, the customized design may be stitched, embroidered, laser etched, or otherwise applied to one or more portions of the article of footwear. In still other cases, the customized design could be applied using a combination of these various methods.

During a sixth step 212, once the customized design has been applied to one or more pre-cut portions, retailer 201 may create a kit of parts that includes provisions for self assembling the article of footwear. In particular, the kit of parts may include the pre-cut portions, a lace and a set of instructions. The set of instructions preferably includes directions for assembling the article of footwear.

At this point, customer 200 may receive the kit during seventh step 214. Then, customer 200 may take the kit home and open it up. During an eighth step 216, customer 200 may read the instructions. Finally, during a ninth step 218, customer 200 may assemble the article of footwear using the pre-cut portions and the lace supplied with the kit.

The following description discusses the details of the steps outlined and briefly described with reference to FIG. 2. In this preferred embodiment, customer 200 has access to a remote terminal or a computer located at a retail location. Using the remote terminal or computer, customer 200 may gain access to a website supplied by retailer 201 or a third party. In some embodiments, the website may include a graphical interface system, as discussed briefly in first step 202.

Figure 3:
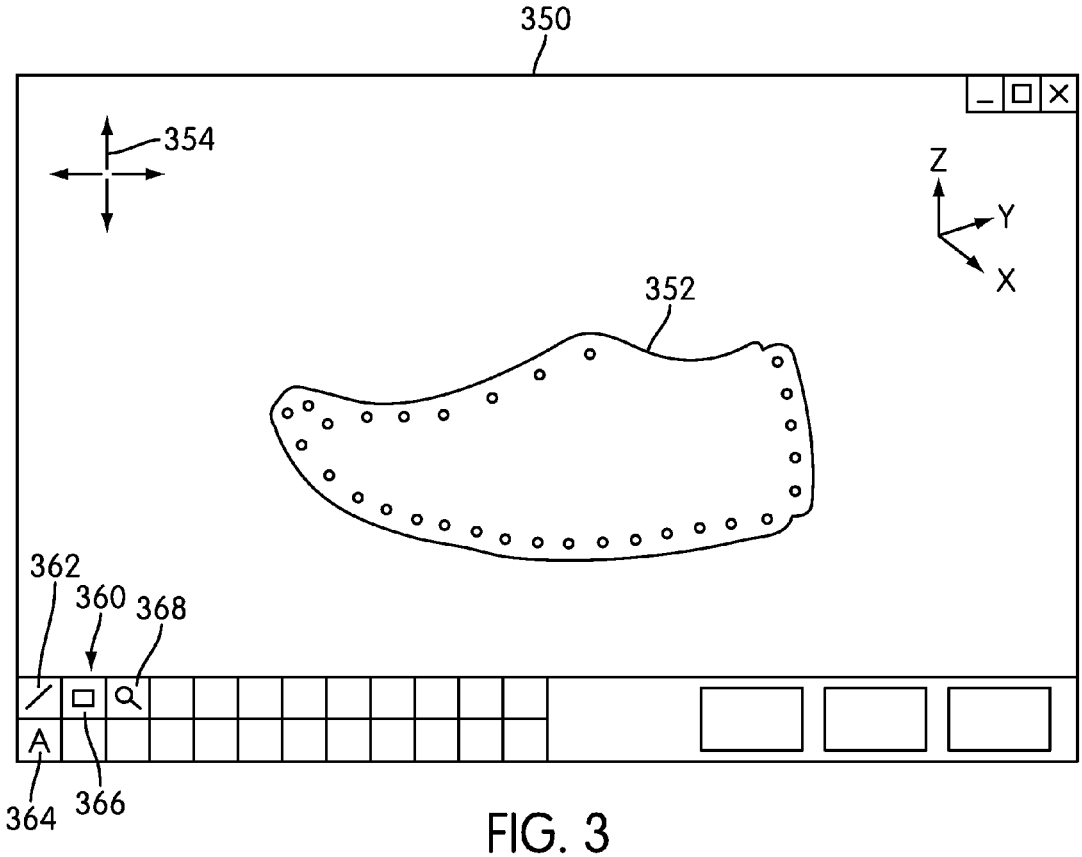
FIG. 3 is a preferred embodiment of a graphical interface system with provisions for customizing an article of footwear.

Referring to FIG. 3, graphical interface system 350 preferably includes footwear representation 352. The term "footwear representation", refers to a three-dimensional embodiment of an article of footwear within a graphical interface system. Specifically, the term footwear representation preferably includes the structural design of the represented article of footwear. Additionally, the term footwear representation preferably includes any other design attributes including, but not limited to, patterns, shapes, designs, colors, images, and any other graphical features of the outer surface of the represented article of footwear.

In the current embodiment, footwear representation 352 is illustrated as a side portion of an article of footwear prior to assembly. As a user moves and/or rotates footwear representation 352, various pre-assembly portions could be shown, including other side portions, bottom portions and tongue portions. However, in other embodiments, a footwear representation could be shown as an assembled article of footwear as well.

Generally, any type of footwear may be designed using the current method. In some embodiments, the method of customizing an article of footwear for self assembly may be applied to articles of footwear that do not require sophisticated attachment provisions, such as heavy duty adhesives or complicated stitching arrangements. In some cases, the current method may be used for customizing booties or other simple articles that can be easily self assembled. In a preferred embodiment, the current method may be used for customizing baby booties that are configured for self assembly.

It should be understood, however, that this method is not restricted to use with baby booties. In other embodiments, for example, additional provisions could be supplied for creating articles of footwear with increased structural support. For example, in other embodiments, the current method could include providing a rubber sole in a kit for self assembly, which may be used to create other types of footwear besides booties. Examples of other types of footwear that may be customized and configured for self assembly include but are not limited to, boots, basketball shoes, running shoes, dance shoes, as well as other kinds of footwear.

Additionally, throughout this specification, it should be understood that not only a single article of footwear, but a pair of footwear may be designed with a customization system. Any designs, tools, or other mechanisms applied to the design of one article of footwear may likewise be applied to a second, complementary, article of footwear. The term "complementary", as used throughout this specification and in the claims, refers to the association of a left article of footwear with a right article of footwear and vice-versa. Also, it should be understood that each article of footwear of a pair may be designed independently. In other words, the complementary articles of footwear need not include identical designs.

In some embodiments, a graphical interface system may include provisions for modifying the view of a footwear representation. Generally, any of the provisions that have been previously disclosed in the customization case may be used in the current embodiment. In the current embodiment, graphical interface system 350 preferably includes directional tool 354 that may be used to move, rotate or otherwise modify the view of footwear representation 352.

Additionally, a graphical interface system may include provisions for modifying a footwear representation. In some embodiments, graphical interface system 350 may include graphics tools configured to modify the design of footwear representation 352. In a preferred embodiment, graphical interface system 350 may include tools similar to those found in many graphical editing programs, such as those that draw lines, add text, as well as other features.

Preferably, graphical interface system 350 may include toolbar 360. Toolbar 360 is preferably a collection of various graphics tools. In some embodiments, toolbar 360 may include line tool 362. Additionally, toolbar 360 may include text tool 364. In some embodiments, toolbar 360 may also include shape tool 366 and magnification tool 368. Generally, toolbar 360 may include many additional graphics tools. For illustrative purposes, only a few of the many possible graphics tools are shown here.

These tools may be used in any combination to create customized designs. It should be understood that the designs illustrated in this disclosure and in the customization case are only meant to be illustrative and in other embodiments any arrangement of lines, shapes or other types of graphics could be combined to create customized designs.

In some embodiments, graphical interface system 350 may include a set of pre-existing designs. For example, the pre-existing images may be associated with images or indicia suited for babies or toddlers and include, but are not limited to, images of teddy bears, flowers, rattles, hearts, as well as other images or indicia commonly associated with babies and toddlers. These pre-existing images may be loaded into memory associated with graphical interface system 350 and may be made available on a website or at a terminal in a kiosk, in some cases.

Figure 4:
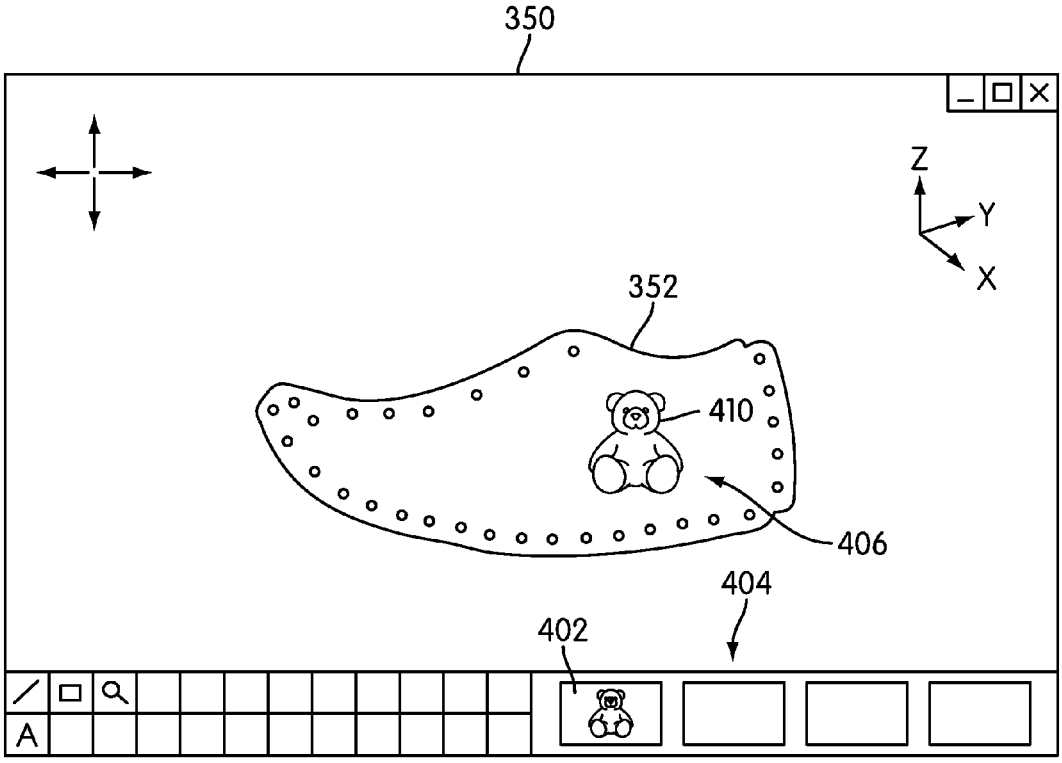
FIG. 4 is a preferred embodiment of a graphical interface system with provisions including an image palette for customizing an article of footwear.

Referring to FIG. 4, graphical interface system 350 includes first image 402 within image palette 404. In this embodiment, first image 402 is an image of a teddy bear. In other embodiments, first image 402 could be any type of image. In this case, first image copy 410 is applied to rear region 406 of footwear representation 352. This may be accomplished by selecting first image 402 from image palette 404. At this point, first image copy 410 may appear. Then, using directional tool 354, first image copy 410 may be moved to rear region 406. In other embodiments, first image 402 may be applied to any region or portion of footwear representation 352 using these same steps.

In other embodiments, a graphical interface system may include provisions for allowing a customer to import various designs or graphics from outside sources, as previously disclosed. In some embodiments, a customer may attach various media devices to a remote terminal or a computer in order to import various graphics or designs to the graphical interface system. In some cases, for example, a customer may upload pictures or photos from a digital camera or from another source. These customer imported images may generally be applied to a footwear representation in a manner similar to that described previously for first image 402.

Figure 5:
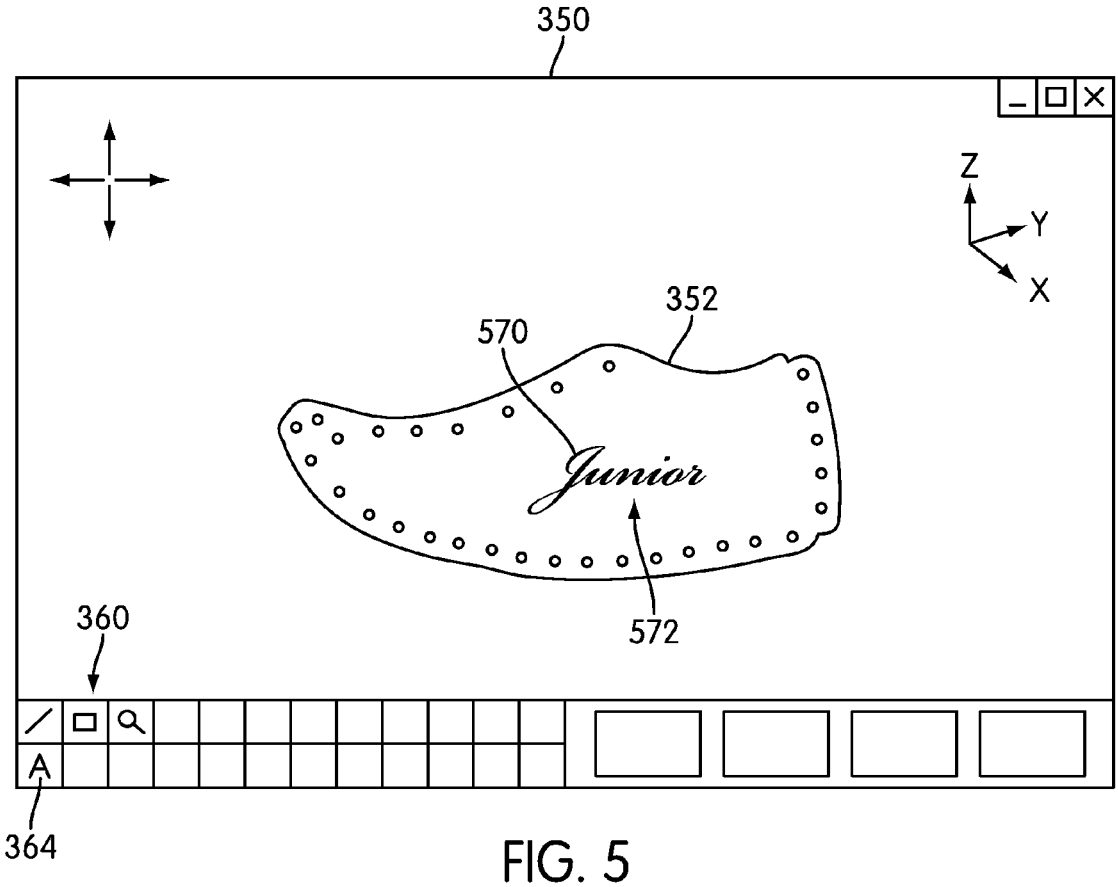
FIG. 5 is a preferred embodiment of a graphical interface system with provisions including a text tool for customizing an article of footwear.

In another embodiment, shown in FIG. 5, one or more words could also be applied to footwear representation 352, using text tool 364. In this embodiment, first word 570 has been applied to side region 572 of footwear representation 352. In this case, the word "Junior" is applied, however in other embodiments any words could be applied including the name of a baby or toddler as well as initials.

Once a customer has chosen a customized design, the finalized design may be submitted to the retailer. In some cases, the customized design can be submitted through the Internet. In other cases, the customized design can be submitted at a retail store using a form or through a remote terminal or computer at the retail store. In still other cases, the customized design may be mailed or faxed to the retailer for processing.

Figure 6:
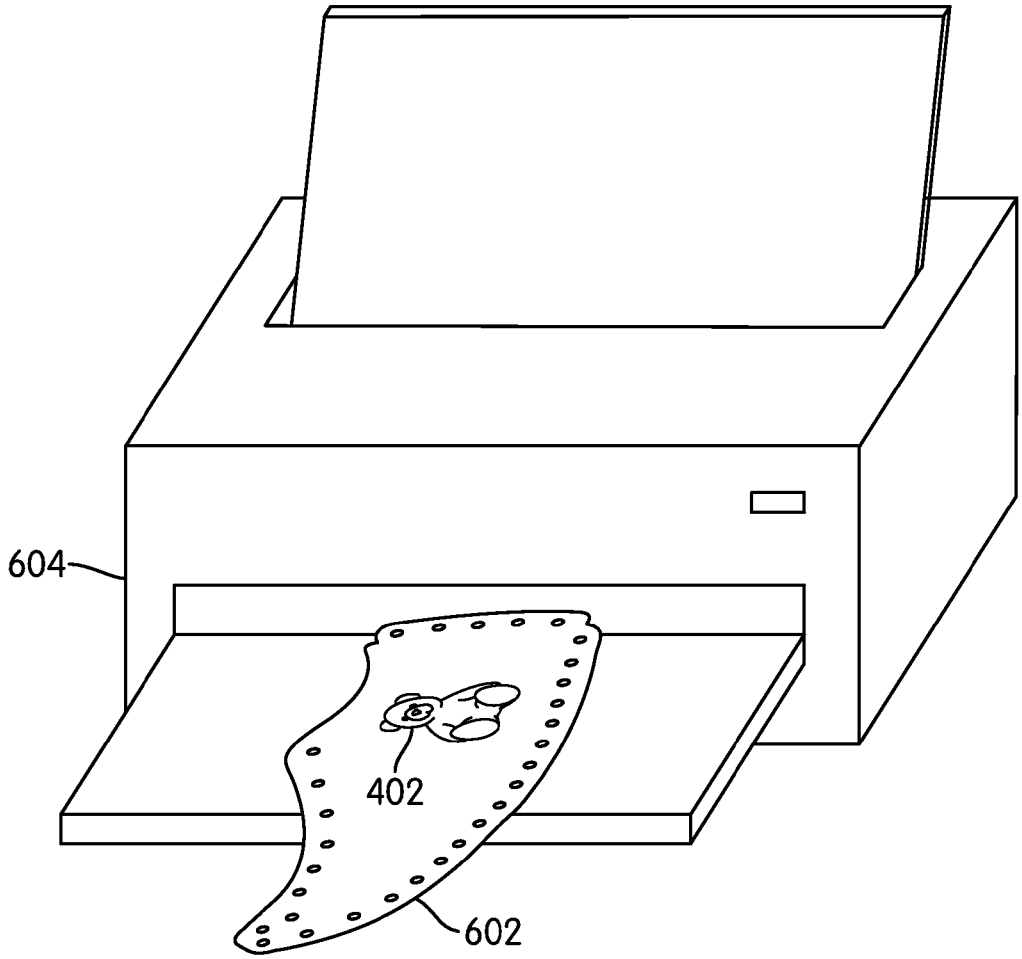
FIG. 6 is an isometric view of a preferred embodiment of a customized design being applied to a pre-cut portion using a printer.
Figure 7:
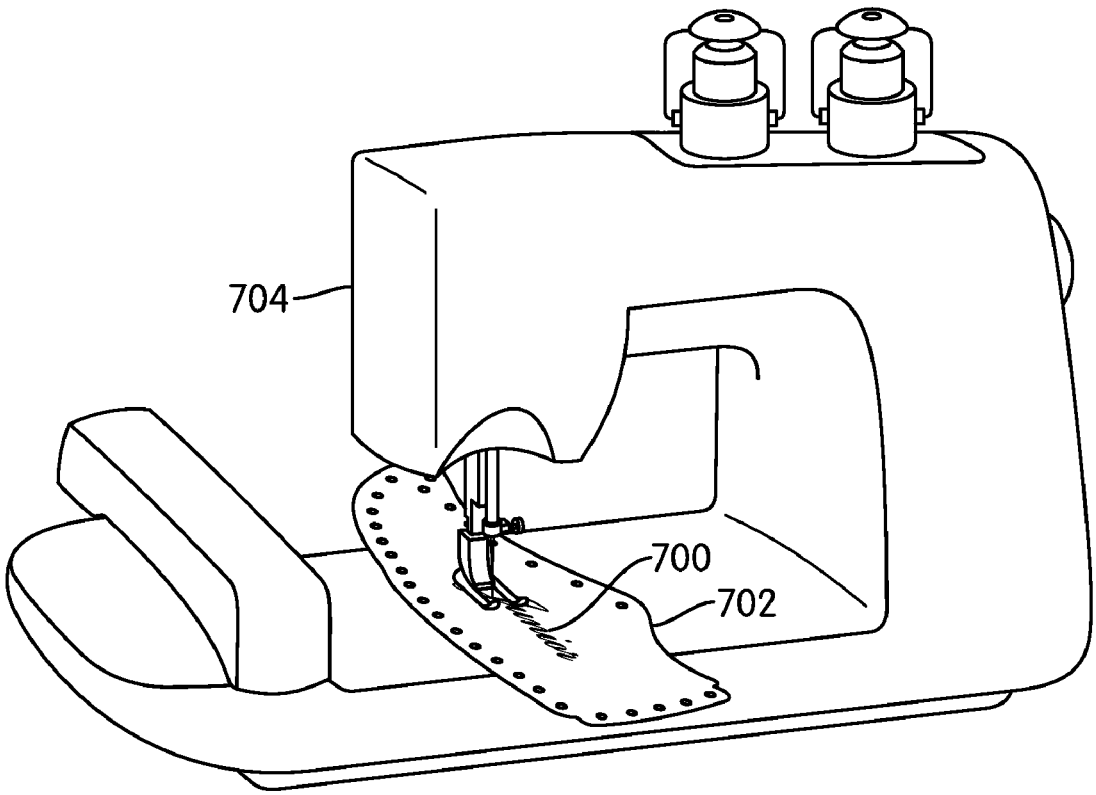
FIG. 7 is an isometric view of a preferred embodiment of a customized design being applied to a pre-cut portion using a stitching machine.
Figure 8:
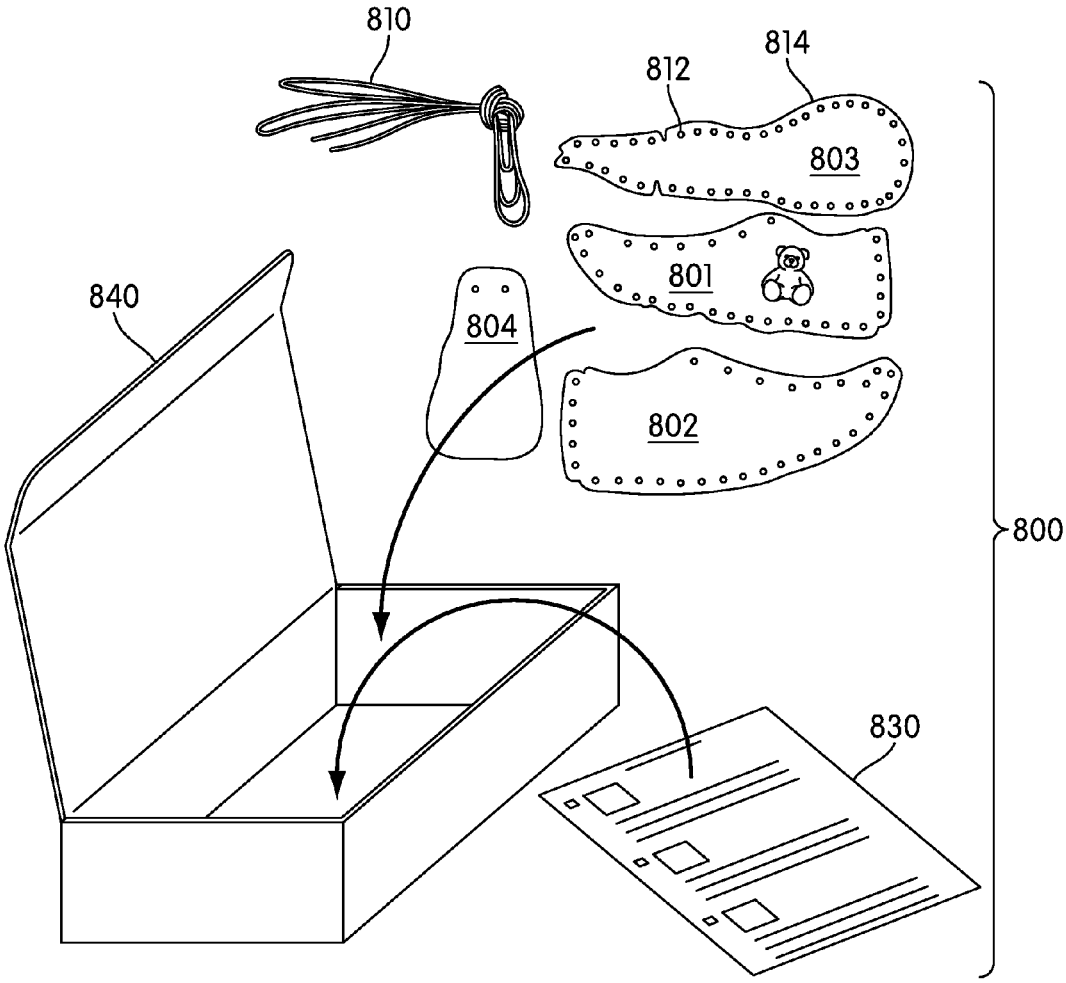
FIG. 8 is a preferred embodiment of a kit of parts.

Referring to FIGS. 6-8, after receiving the customized design from the customer, a retailer may proceed to apply the customized design to one or more pre-cut portions associated with an article of footwear. In this embodiment, the retailer may receive pre-cut portions from a manufacturer prior to receiving a customized design. In other embodiments, the pre-cut portions could be cut from a sheet material at the retail location.

As previously mentioned, a customized design may be applied to one or more portions of an article of footwear using any known method for applying designs. In some embodiments, the customized design may be applied using a printer. In a preferred embodiment, the customized design could be digitally printed to one or more pre-cut portions.

FIG. 6 is a preferred embodiment of a customized design being applied to a pre-cut portion. In this embodiment, first image 402 is applied to first pre-cut portion 602 using printer 604. Generally, printer 604 may be any type of printer, including, but not limited to a dot matrix printer, an ink jet printer, a laser printer, as well as another kind of printer. In a preferred embodiment, printer 604 may be any digital printer. In this embodiment, first pre-cut portion 602 is a side pre-cut portion of an article of footwear. In other embodiments, first pre-cut portion 602 could be a tongue pre-cut portion, a bottom pre-cut portion, or any other type of pre-cut portion.

Although FIG. 6 only illustrates the printing of a single pre-cut portion, it should be understood that customized designs may also be applied to other pre-cut portions using printer 604. In some embodiments, each pre-cut portion may be automatically or manually fed through printer 604. In other embodiments, only pre-cut portions configured to receive customized designs may be fed through printer 604. In other words, as some regions of an article of footwear may not include customized designs, the pre-cut portions associated with these regions may not be fed through a printer. In some embodiments, the pre-cut portions may be attached to cardstock or similar sheets of paper or paper-like material. In some embodiments, the pre-cut portions may be adhered to the cardstock, for example by using a removable adhesive. This configuration may permit the pre-cut portions to more easily be fed through printer 604 or other customization machine. After customization, the pre-cut portions may be peeled or otherwise removed from the cardstock for assembly.

In other embodiments, a customized design may be applied to one or more pre-cut portions by stitching. Referring to FIG. 7, first word 570 may be embroidered into first pre-cut portion 702 of an article of footwear using stitching machine 704. In some cases, stitching machine 704 is a sewing machine. In other embodiments, stitching machine 704 is an embroidering machine. For purposes of illustration, a standard sewing machine is shown the current embodiment, however in a preferred embodiment stitching machine 704 may be an industrial sewing or embroidering machine.

Although FIG. 7 only illustrates the embroidering of a single pre-cut portion, it should be understood that customized designs may also be applied to other pre-cut portions using stitching machine 704. In some embodiments, each pre-cut portion may be automatically or manually fed through stitching machine 704. In other embodiments, only pre-cut portions configured to receive customized designs may be fed through stitching machine 704. In other words, as some regions of an article of footwear may not include customized designs, the pre-cut portions associated with these regions may not be fed through stitching machine 704.

FIGS. 6 and 7 are only meant to illustrate possible methods of applying customized designs to pre-cut portions of an article of footwear. In other embodiments, customized designs could be applied to pre-cut portions using other methods. In some cases, the customized designs could be laser etched on the pre-cut portions. In other cases, the customized designs could be applied using other methods such as painting or stenciling.

In some cases, a customer may select the type of medium used for applying a customized design. For example, in some embodiments, a graphical interface system may include options for selecting 'print', 'embroider' or other methods of application. In other cases, the medium may be pre-selected by the retailer or manufacturer. In still other cases, some types of designs may be associated with specific types of mediums. For example, any designs created using the text tool could be embroidered onto the pre-cut portions, while any designs using a pre-designated image could be applied using a digital printer. Generally, any combination of application methods could be used to apply customized designs to one or more pre-cut portions.

In some embodiments, the pre-cut portions including portions with customized designs may be packaged into a kit of parts. In some cases, the kit of parts may also include additional provisions for assembly. In a preferred embodiment, the kit of parts may also include a lace that is used to attach the pre-cut portions together. Additionally, the kit of parts may also include a set of instructions for self assembly.

FIG. 8 is a preferred embodiment of kit of parts 800. In this embodiment, kit of parts 800 may include a plurality of pre-cut portions, including first pre-cut portion 801, second pre-cut portion 802, third pre-cut portion 803 and fourth pre-cut portion 804. In a preferred embodiment, first pre-cut portion 801 is a lateral side portion of an article of footwear. Additionally, second pre-cut portion 802 is a medial side portion of an article of footwear. Also, third pre-cut portion 803 may be a bottom portion of an article of footwear. And finally, fourth pre-cut portion 804 may be a tongue portion of an article of footwear. Preferably, pre-cut portions 801-804 comprise all the portions of a single article of footwear.

Although four pre-cut portions are shown in the current embodiment, in other embodiments any number of pre-cut portions may be used. In other embodiments, the article of footwear may be associated with two or three pre-cut portions. In still other embodiments, the article of footwear may be associated with more than four pre-cut portions.

Generally, pre-cut portions may be made from any material. In some cases, the pre-cut portions could be made of natural leather. In other cases, the pre-cut portions could be made of synthetic leather. In still other embodiments, the pre-cut portions could be made of a fabric or textile of some kind, including both natural and synthetic materials. Additionally, in some cases, different pre-cut portions could be made of different materials. For example, a bottom pre-cut portion could be made of durable leather, while side pre-cut portions could be made of a lightweight fabric material.

Preferably, a kit of parts includes provisions for attaching one or more pre-cut portions to one another. Generally, the kit of parts may include any fastening mechanism to attach the pre-cut portions. Examples of fastening mechanisms include, but are not limited to, zippers, buttons, snaps, hook and loop fasteners as well as other types of fasteners. In a preferred embodiment, the kit of parts may include a lace that is used to stitch adjacent pre-cut portions together.

In the current embodiment, kit of parts 800 may include lace 810. Preferably, lace 810 is a shoelace. The current embodiment includes only a single lace, however, in other embodiments, kit of parts 800 may comprise additional laces as well.

Preferably, pre-cut portions 801-804 include provisions for receiving lace 810. In some embodiments, pre-cut portions 801-804 may include holes 812. In a preferred embodiment, holes 812 may be disposed on peripheral portions 814 of pre-cut portions 801-804. Using this arrangement, lace 810 may be used to stitch adjacent pre-cut portions to one another at peripheries 814.

Kit of parts 800 may also include set of instructions 830. In some embodiments, set of instructions 830 may include a list of directions for assembling an article of footwear from pre-cut portions 801-804 and lace 810. In some cases, set of instructions 830 may include step by step directions. In other cases, set of instructions 830 may include diagrams as well.

Preferably, the components comprising kit of parts 800 may be gathered together for a customer. In some embodiments, the components comprising kit of parts 800 may be packaged together so a customer can carry kit of parts 800 home. In some cases, pre-cut portions 801-804, lace 810 and set of instructions 830 may be packaged into box 840. In other embodiments, the components comprising kit of parts 800 could be packaged in a retail bag. Using this arrangement, a customer may easily carry home kit of parts 800 or receive kit of parts 800 in the mail.

For illustrative purposes, only the components needed to assemble a single article of footwear are shown in the present embodiments. However, it should be understood that a second set of pre-cut portions as well as a second lace are preferably provided in a kit of parts to allow for the self assembly of a pair of footwear, rather than just a single article of footwear.

Figure 9:
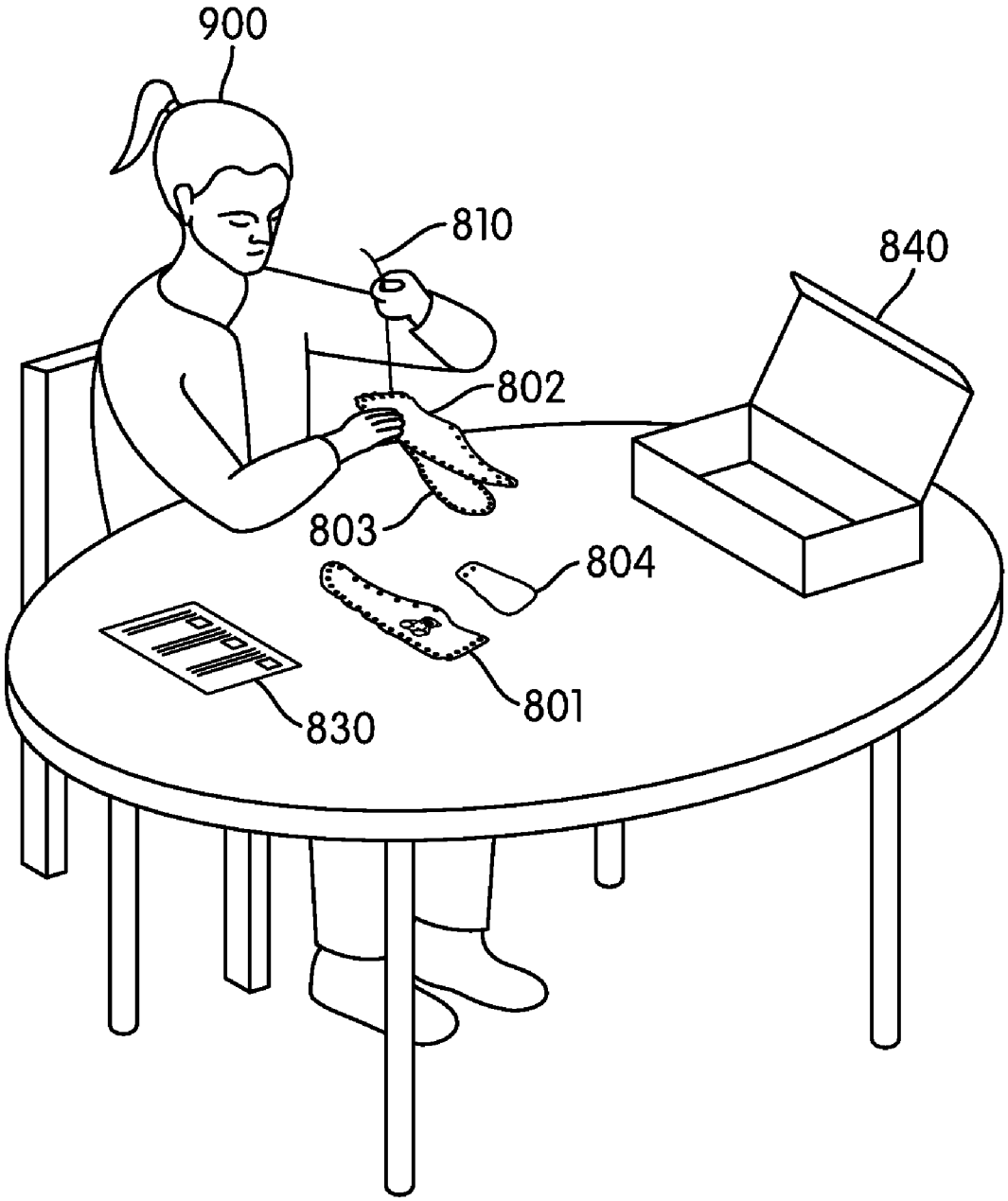
FIG. 9 is a preferred embodiment of a customer assembling an article of footwear.

FIG. 9 is a preferred embodiment of customer 900 assembling an article of footwear from pre-cut portions 801-804 and lace 810. In this embodiment, customer 900 has removed pre-cut portions 801-804, lace 810 and set of instructions 830 from box 840. Using set of instructions 830, customer 900 may assemble pre-cut portions 801-804 together using lace 810.

In some cases, a customer who customizes and self assembles the articles of footwear such as a baby bootie may be an expecting mother, an expecting father or soon to be grandparents, as well as parents or grandparents of a young toddler. By customizing and assembling the articles of footwear, the customer gives something they made to the baby or toddler, which may increase the sentimental value of the articles of footwear and may give the customer a sense of accomplishment.

Figure 10:
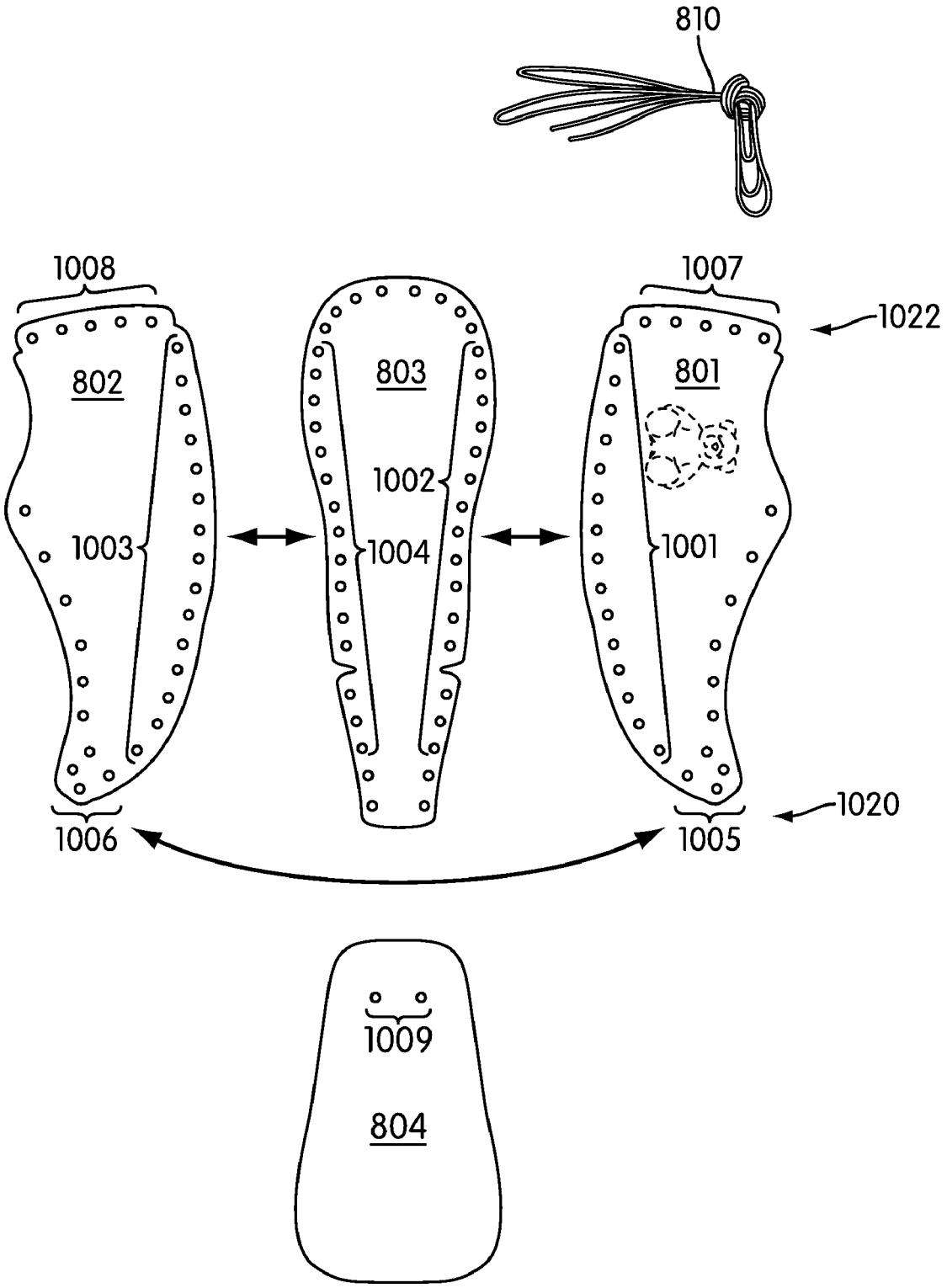
FIG. 10 is a preferred embodiment of pre-cut portions of an article of footwear.

Referring to FIG. 10, pre-cut portions 801-804 may be stitched together using lace 810. In some embodiments, lace 810 may be stitched through holes 812 of adjacent pre-cut portions in order to fasten adjacent pre-cut portions together. For example, in some cases, third pre-cut portion 803 may be fastened to first pre-cut portion 801 by stitching lace 810 between first set of holes 1001 and second set of holes 1002. Likewise, third pre-cut portion 803 may be fastened to second pre-cut portion 802 by stitching lace 810 between third set of holes 1003 and fourth set of holes 1004. This arrangement may stitch pre-cut portions 801, 802 and 803 together along a bottom side of the article of footwear.

Additionally, second pre-cut portion 802 and first pre-cut portion 801 may be stitched together at a forward end 1020 by stitching lace 810 between fifth set of holes 1005 and sixth set of holes 1006. Also, second pre-cut portion 802 and first pre-cut portion 801 may be fastened to third pre-cut portion 803 at a rearward end 1022 by stitching lace 810 between seventh set of holes 1007 and eleventh set of holes 1113, as well as by stitching lace 810 between eighth set of holes 1008 and tenth set of holes 1111. In some cases, a rear portion of third pre-cut portion 803 may be folded upwards and associated with pre-cut portions 801 and 802 prior to stitching. This arrangement generally forms a heel for the assembled article of footwear.

Finally, fourth pre-cut portion 804 may be fastened to pre-cut portions 801 and 802 at forward end 1020 by stitching lace 810 through fifth set of holes 1005, sixth set of holes 1006 and ninth set of holes 1009. Using this arrangement, fourth pre-cut portion 804 may be used as a tongue for the assembled article of footwear.

Preferably, lace 810 may be stitched through sets of holes 1001-1009 according to set of instructions 830. Generally, any kind of stitching may be used to accomplish the attachment of pre-cut portions 801-804 to one another. In some cases, simple stitches can be used. In other cases, more complex stitches can be used. Examples of various stitches that may be used include, but are not limited to, backstitches, basting stitches, blind stitches, buttonhole stitches, chain stitches, cross-stitches, embroidery stitches, feather stitches, hemming stitches, lock stitches, padding stitches, running stitches, slip stitches, stretch stitches, top stitches, whip stitches, zigzag stitches as well as any other types of stitches.

In other embodiments, pre-cut portions 801-804 may not include pre-configured holes. Instead, pre-cut portions 801-804 may be stitched together using thinner laces that are configured to penetrate through pre-cut portions 801-804. This alternative arrangement may allow for increased variety in stitching techniques, which may appeal to some customers.

In some embodiments, an article of footwear may include provisions for fastening an upper from an open position to a closed position around a foot. The term "open position" as used in this detailed description and throughout the claims, refers to a loosened position of an article of footwear in which a foot may be easily slipped into the article of footwear. The term "closed position", as used throughout this detailed description and in the claims, refers to a tightened position of an article of footwear in which the article of footwear is tightly wrapped around the foot and cannot be generally removed.

In some cases, the article of footwear may include a lace of some kind for fastening the article. In this preferred embodiment, the lace used to attach one or more pre-cut portions together is also used to fasten the upper around a foot. In particular, the lace may include a first end portion, a second end portion and an intermediate portion. Preferably, the intermediate portion is disposed between the first end portion and the second end portion and is used to fasten one or more pre-cut portions together. Additionally, the end portions may be associated with a set of lacing holes and may be configured to adjustably fasten an upper of the article of footwear from an open position to a closed position.

Figure 11:
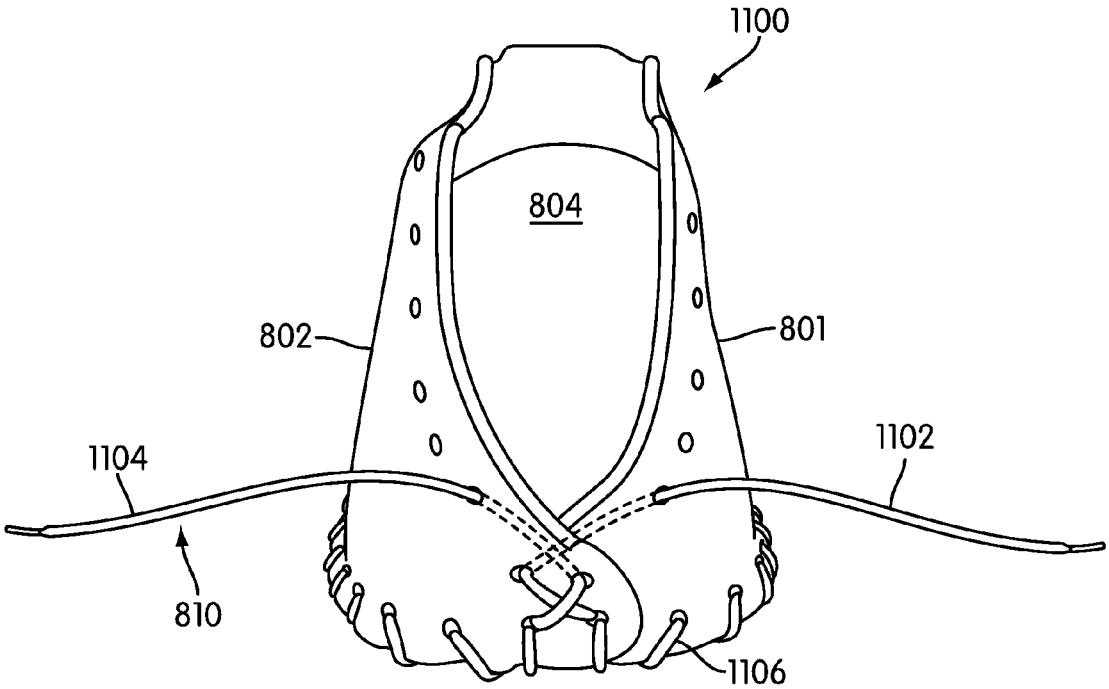
FIG. 11 is a preferred embodiment of an article of footwear assembled and partially laced.

FIG. 11 is a preferred embodiment of article of footwear 1100 that has been assembled from pre-cut portions 801-804, using lace 810. In this embodiment, lace 810 preferably includes first end portion 1102, second end portion 1104 and intermediate portion 1106. Preferably, intermediate portion 1106 is disposed between first end portion 1102 and second end portion 1104. In particular, intermediate portion 1106 may be inserted through multiple sets of holes and used to fasten the pre-cut portions together.

Figure 12:
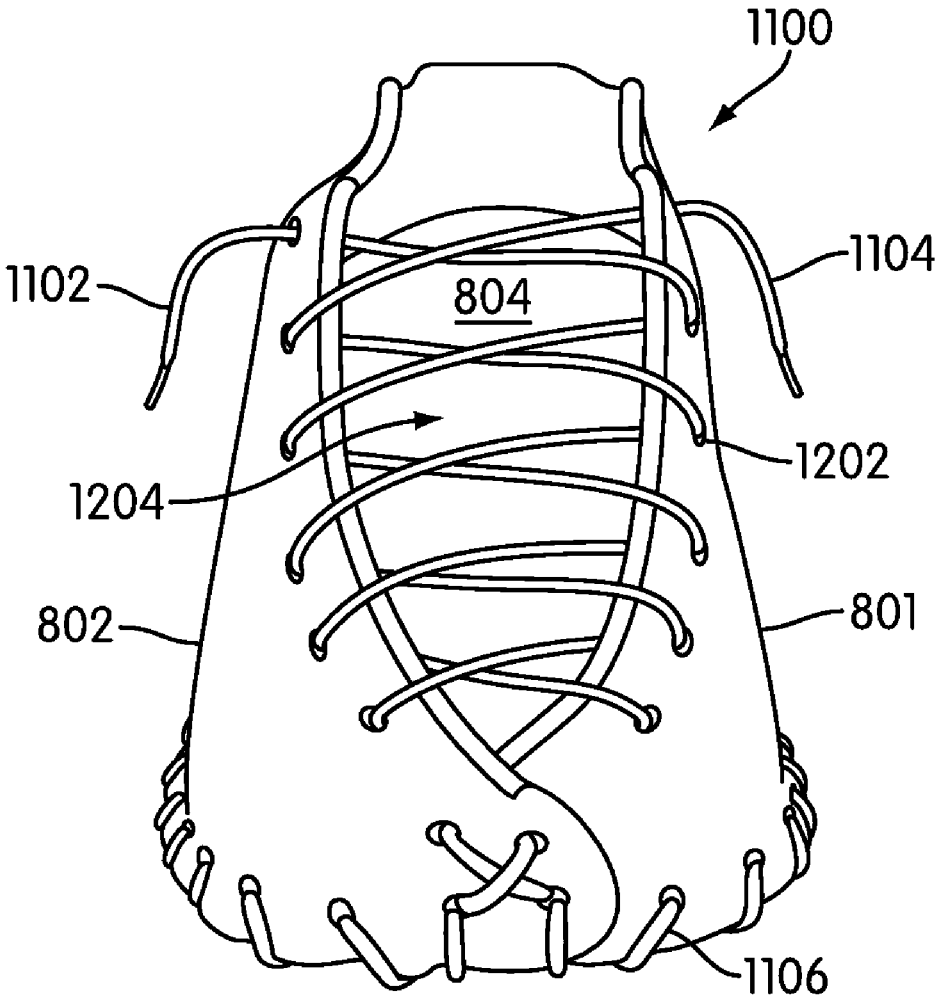
FIG. 12 is a preferred embodiment of an article of footwear assembled and laced.

Referring to FIG. 12, first end portion 1102 and second end portion 1104 may be inserted through lacing holes 1202. In this embodiment, lacing holes 1202 are associated with a top region 1204 of article of footwear 1100. In some cases, top side 1204 may be a vamp portion. In other embodiments, lacing holes 1202 could be associated with other regions of article of footwear 1100.

Using this arrangement, lace 810 may be used to tighten article of footwear 1100 from an open position to a closed position. In a preferred embodiment, this tightening may be accomplished by pulling end portions 1102 and 1104 through lacing holes 1202, and in some cases, making a knot with end portions 1102 and 1104.

In some embodiments, different portions of a lace may be made of different materials. In some cases, an intermediate portion may be made of a different material than one or more end portions. For example, the intermediate portion may be made of a durable plastic material for assembling the pre-cut portions. Likewise, the end portions may be made of a generally elastic material that provides increased tension at a fastening region of the article of footwear. In other embodiments, the different portions may be made of other materials. Materials that may be used include, but are not limited to, leather, cotton, textured polyester, spun polyester, nylon, polypropylene and plastic.

In some embodiments, an article of footwear may include provisions to prevent a lace from slipping through a set of lacing holes and interfering with the fastening of the pre-cut portions. In some cases, the lacing holes may include provisions to prevent the lace from slipping through the holes. In a preferred embodiment, the lace may include provisions so that it does not slip through the lacing holes after the article of footwear has been assembled.

Figure 13:
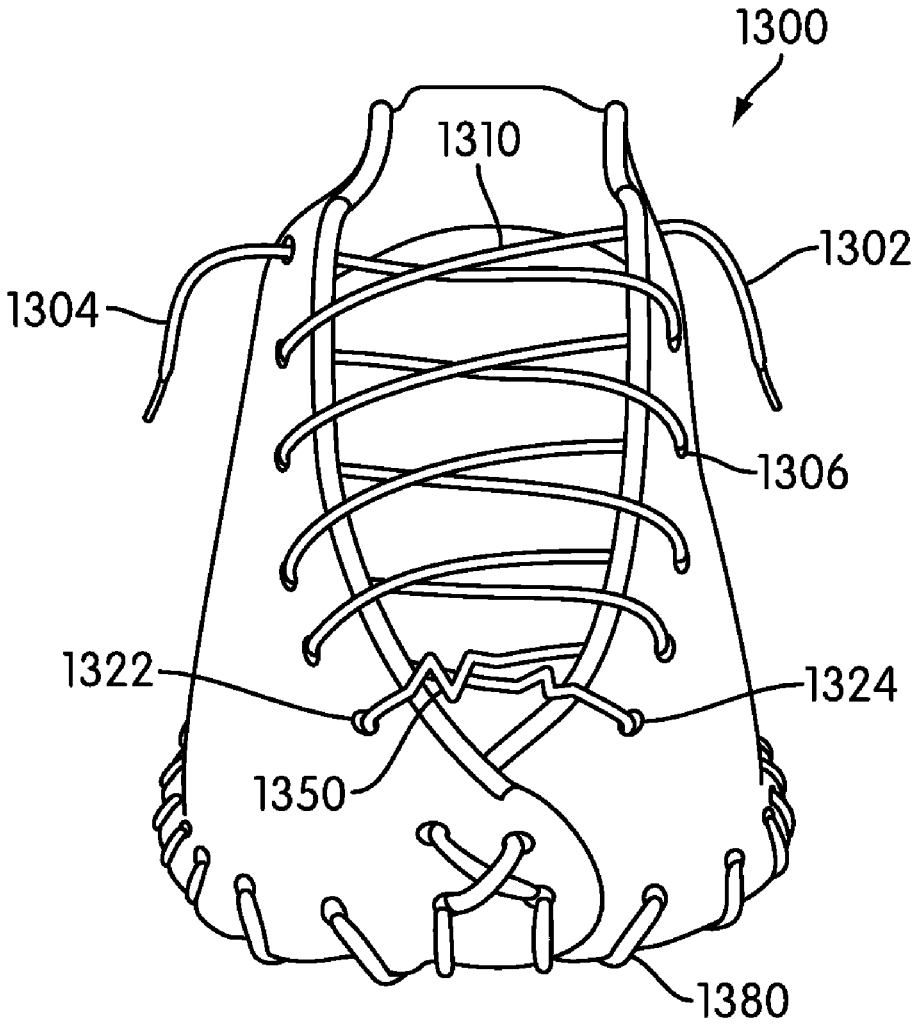
FIG. 13 is a preferred embodiment of an article of footwear with crimped laces.

FIG. 13 illustrates a preferred embodiment of article of footwear 1300 with lace 1310. Article of footwear 1300 may include all the various features discussed in the previous embodiments. In particular, article of footwear 1300 may be assembled from multiple pre-cut portions.

As discussed in the previous embodiments, a lace may include end portions and an intermediate portion. In this preferred embodiment, lace 1310 includes first end portion 1302, second end portion 1304 and intermediate portion 1380. Preferably, lacing holes 1306 are configured to receive first end portion 1302 and second end portion 1304. Generally, first end portion 1302 and second end portion 1304 may be used to tighten article of footwear 1300 from an open position to a closed position. Additionally, intermediate portion 1380 may be associated with multiple sets of holes and may be used to assemble the pre-cut portions, as discussed in the previous embodiments.

After a customer assembles the pre-cut portions of article of footwear 1300 with intermediate portion 1380 of lace 1310, the customer may deform first end portion 1302 of lace 1310 above first lacing hole 1322. Additionally, the customer may deform second end portion 1304 above second lacing hole 1324. Preferably, end portions 1302 and 1304 may be deformed to create crimped regions 1350 in lace 1310.

Generally, a customer may deform end portions 1302 and 1304 using any known method to introduce crimped regions 1350. In some cases, end portions 1302 and 1304 may be made of a material that is configured to substantially deform. In these cases, once a user bends end portions 1302 and 1304 to form crimped portions 1350, portions 1302 and 1304 may remain substantially permanently deformed. Alternatively, a customer may first apply heat from a hair dryer or iron, for example, and then deform end portions 1302 and 1304 to create crimped regions 1350. Preferably, end portions 1302 and 1304 are manufactured of a material with sufficient stiffness so that crimped regions 1350 remain deformed during the lifetime of article of footwear 1300.

Using this configuration, crimped regions 1350 preferably block end portions 1302 and 1304 from slipping through lacing holes 1322 and 1324, respectively. With crimped regions 1350 blocking lacing holes 1322 and 1324, a customer may tighten or loosen article of footwear 1300 around a foot without interfering with the assembly of article of footwear 1300. This may be particularly helpful when article of footwear 1300 is removed from a foot so that lace 1310 does not slip through lacing holes 1322 and 1324 and disrupt the assembly of the pre-cut portions.

In other embodiments, other provisions may be employed to block a lace from slipping through a set of lacing holes. In some cases, a kit of parts may include additional parts that may be configured to lock a lace so that it does not slide through a lacing hole. In a preferred embodiment, additional parts may be fitted around a lace so that it does not slide through a set of lacing holes.

Figure 14:
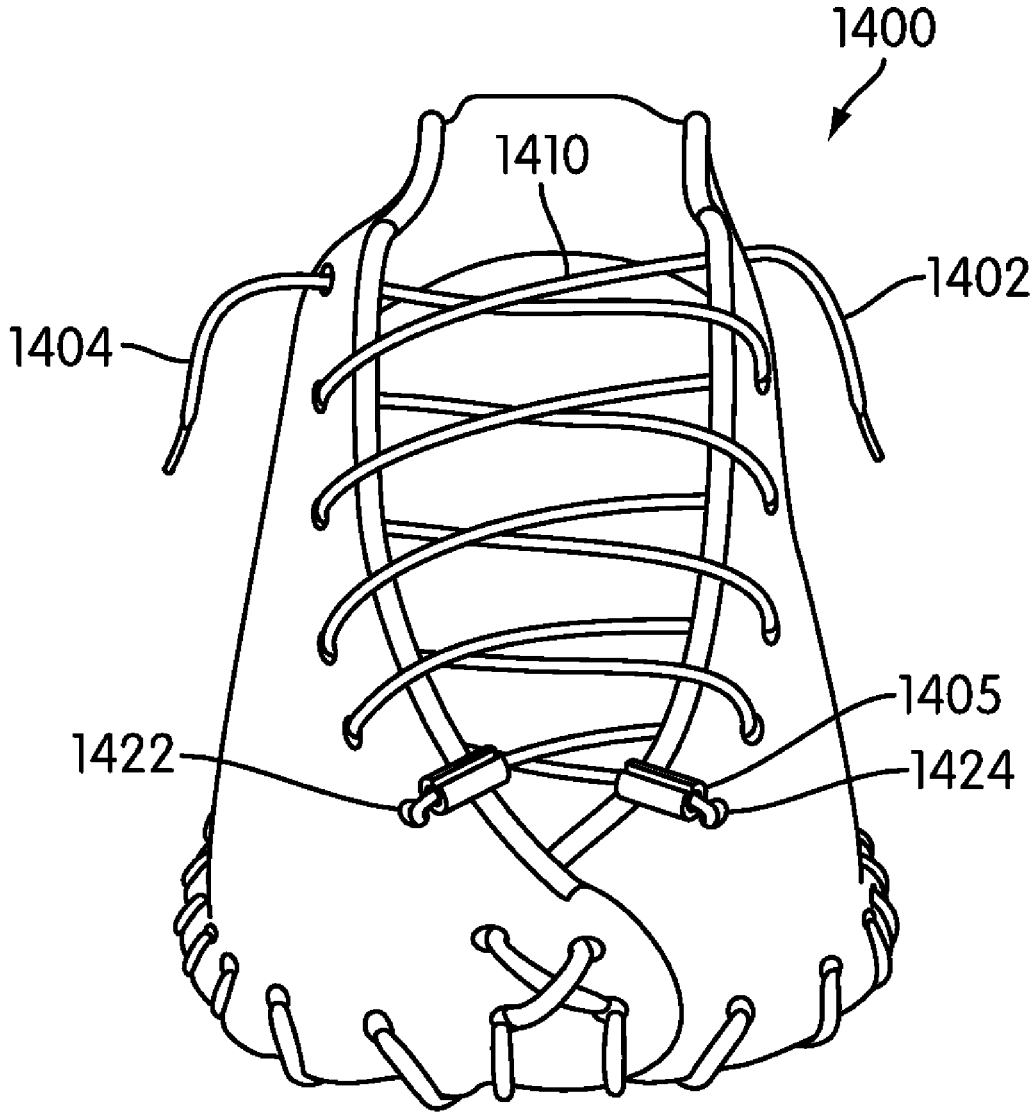
FIG. 14 is a preferred embodiment of an article of footwear with lace locks.

FIG. 14 is a preferred embodiment of article of footwear 1400 with lace locks 1405 snapped on lace 1410. In this case, after a customer assembles article of footwear 1400 with lace 1410, lace locks 1405 may be retrieved from a kit of parts and snapped on first end portion 1402 and second end portion 1404 of lace 1410 above first lacing hole 1422 and second lacing hole 1424, respectively. Preferably, lace locks 1405 may be configured to remain fixed at a particular region on lace 1410. This arrangement prevents lace 1410 from slipping through lacing holes 1422 and 1424 and allows the pre-cut portions of article of footwear 1400 to remain securely fastened.

In some embodiments, lace locks 1405 may be cylindrical in shape. In other embodiments, lace locks 1405 may be rectangular in shape. Generally, lace locks 1405 may be any shape and size that prevents lace locks 1405 from sliding through first lacing hole 1422 and second lacing hole 1424. This arrangement preferably prevents end portions 1402 and 1404 from slipping through lacing holes 1422 and 1424.

In these embodiments, provisions for securing first end portions and second end portions in place are adjacent to lacing holes at the bottom of a lacing region of an article of footwear. In other embodiments, however, provisions such as crimped regions or lace locks could be applied at other portions of a lace. Preferably, these provisions are applied near a boundary between an intermediate portion of a lace that is used to fasten pre-cut portions together and end portions of the lace that are used to tighten the article of footwear to a foot.

Although the preceding embodiments discuss a preferred embodiment of a self assembled baby bootie, it should be understood that in other embodiments, these same principle can be applied to make other types of footwear configured for self assembly. In particular, the provisions taught in this detailed description may be used to make articles of footwear that can be worn by both children and adults, as well as babies and toddlers. Often, children and adults require additional support at the bottom of an article of footwear. The following embodiments, illustrated in FIGS. 15-20, discuss additional provisions that may be used to increase support for a self assembled article of footwear. Using these additional provisions, a self assembled article of footwear can be configured to be worn by both children and adults.

An article of footwear may include provisions for supporting and providing comfort to a foot. In some embodiments, an article of footwear may include additional provisions to increase the structural support for a foot. Increased structural support may be useful for baby booties as well as other types of footwear, including boots, basketball shoes, running shoes, dance shoes, as well as other kinds of footwear. In some cases, a self assembled article of footwear may offer increased structural support to a foot by including a midsole.

Figure 15:
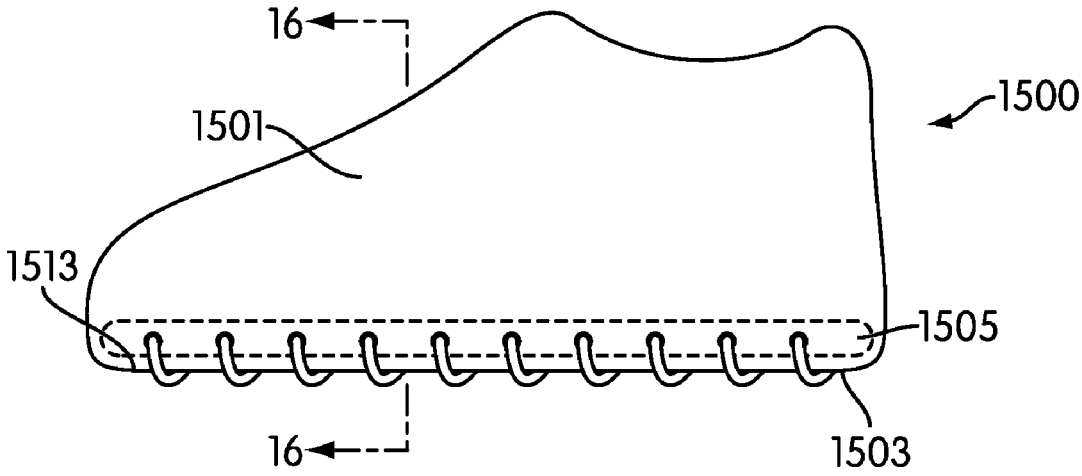
FIG. 15 is a side view of a preferred embodiment of an article of footwear with a midsole.
Figure 16:
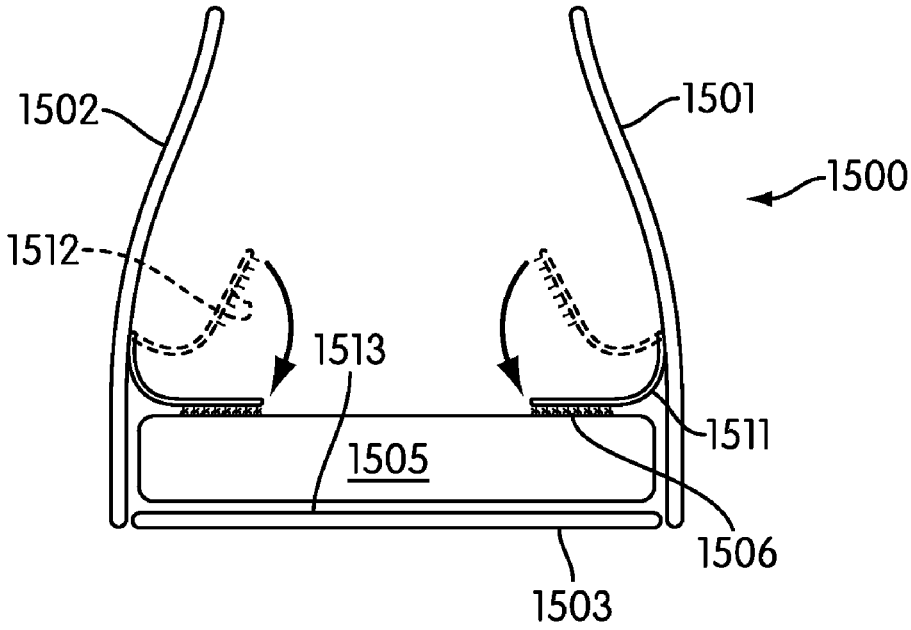
FIG. 16 is a cross sectional view of a preferred embodiment of an article of footwear with a midsole.

FIGS. 15 and 16 are schematic views of an article of footwear assembled from one or more pre-cut portions. Referring to FIGS. 15-16, article of footwear 1500 preferably includes midsole 1505 to provide additional support to a wearer. In a preferred embodiment, midsole 1505 may be included in a kit of parts associated with article of footwear 1500. In other embodiments, midsole 1505 may be purchased separately from a kit of parts associated with article of footwear 1500.

Midsole 1505 is preferably associated with bottom pre-cut portion 1503. In particular, midsole 1505 may be disposed along a top side 1513 of bottom pre-cut portion 1503. In a preferred embodiment, midsole 1505 may be disposed adjacent to the foot of a wearer, once midsole 1505 has been inserted into article of footwear 1500.

Preferably, article of footwear 1500 includes provisions for securing midsole 1505. In some embodiments, lateral pre-cut portion 1501 and medial pre-cut portion 1502 may include fastening strips 1511 to secure midsole 1505 within article of footwear 1500. For ease of assembly, fastening strips 1511 may be attached to pre-cut portions 1501 and 1502 prior to sending the kit of parts to a customer. In some embodiments, fastening strips 1511 may be sewn on pre-cut portions 1501 and 1502. In other embodiments, fastening strips 1511 may be attached with an adhesive to pre-cut portions 1501 and 1502. Generally, fastening strips 1511 may be attached in any known manner.

Fastening strips 1511 may attach to midsole 1505 to secure midsole 1505 within article of footwear 1500. Preferably, midsole 1505 includes first fastening region 1506. Furthermore, fastening strips 1511 may include second fastening region 1512. Generally, fastening regions 1506 and 1512 may include any type of fastening mechanism. Examples of fastening mechanisms include, but are not limited to, zippers, buttons, snaps, hook and loop fasteners as well as other types of fasteners. In this preferred embodiment, fastening regions 1506 and 1512 may be complementary sides of a hook and loop fastener, such as Velcro®. Using this arrangement, fastening strips 1511 may hold midsole 1505 in place with respect to bottom pre-cut portion 1503.

In this embodiment, fastening strips 1511 include two strips to secure midsole 1505. Similarly, midsole 1505 includes two corresponding fastening regions to attach to the two strips. In other embodiments, a different number of strips and/or fastening regions may be used. Furthermore, while this embodiment includes fastening strips 1511 secured to pre-cut portions 1501 and 1502 to secure midsole 1505, in other embodiments midsole 1505 may be secured within article 1500 by other means. For example, fastening regions may be disposed on bottom pre-cut portion 1503 to attach to corresponding fastening regions on midsole 1505. Generally, midsole 1505 may be secured within article of footwear 1500 in any known manner.

In the previous embodiments, an article of footwear included a bottom pre-cut portion made of an upper material, as previously discussed. In some embodiments, a self assembled article of footwear may be associated with a sole portion to provide increased support. The term "sole portion" as used throughout this detailed description and in the claims refers to a portion of an article of footwear that provides enhanced support for a foot. Generally, a sole portion may be made of a cushioning material that is configured for impact absorption. In some cases, a sole may include traction elements or cleats to provide increased traction with the ground.

Generally, a sole portion may be made of any material known in the art for making soles. In some embodiments, a sole portion may be made of polyurethane. In other embodiments, a sole portion may be made of thermoplastic or latex rubber. In still other embodiments, a sole portion may be made of ethyl vinyl acetate (EVA).

Figure 17:
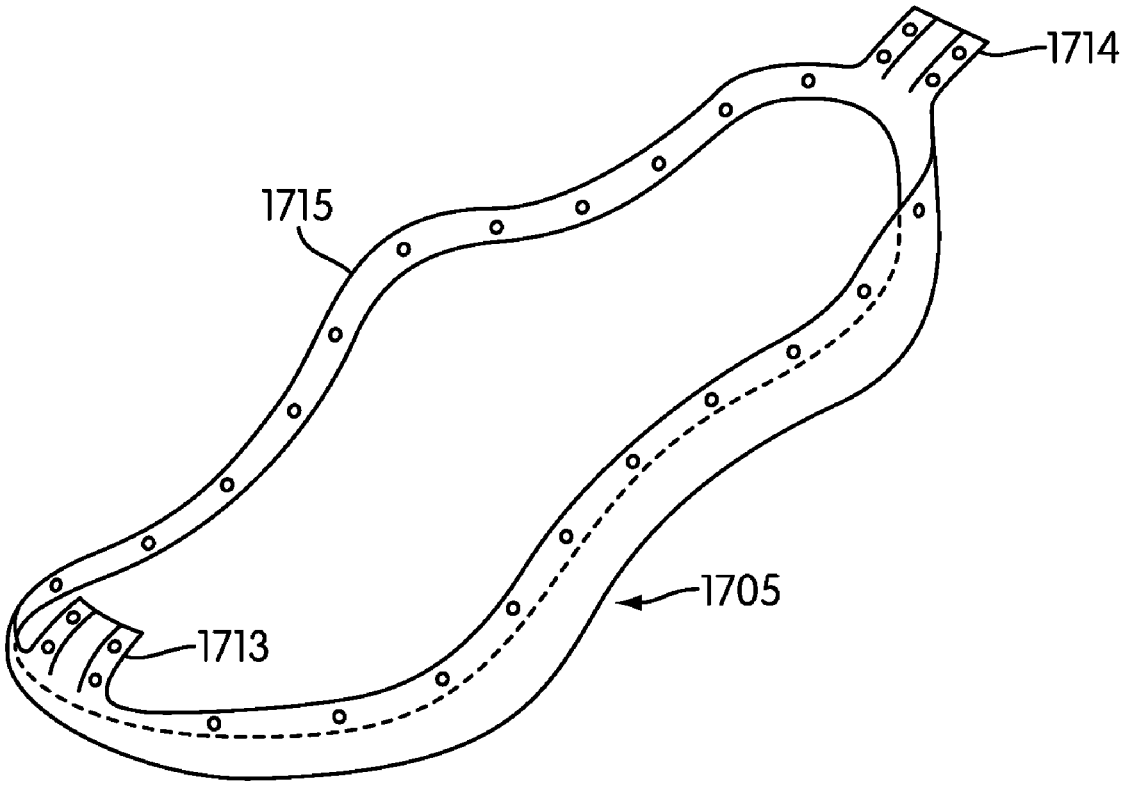
FIG. 17 is an isometric view of a preferred embodiment of a bottom portion with a sole.

FIG. 17 illustrates a preferred embodiment of sole portion 1703. Preferably, sole portion 1703 is substantially thicker than other pre-cut portions that may be made of upper materials including leather and synthetic fibers. Furthermore, sole portion 1703 is generally configured to conform to the shape of a foot to provide additional structural support over a flat bottom pre-cut portion.

Preferably, a sole portion includes provisions for attaching to one or more pre-cut portions to form an assembled article of footwear. In some embodiments, sole portion 1703 may include side flaps 1715. In some cases, side flaps 1715 may be configured to fasten adjacent pre-cut portions to sole portion 1703. Furthermore, sole portion 1703 may include front flap 1713 and rear flap 1714. Using this arrangement, flaps 1713-1715 may be used to fasten adjacent pre-cut portions together and to support a foot on top of sole portion 1703.

In some embodiments, a sole portion may be associated with multiple pre-cut portions that may be assembled together using a lace. Generally, the assembled article of footwear may be configured to be worn by a baby, a child, or an adult. Each of the pre-cut portions may have any design. In some cases, the sole portion could include various designs, including different types of tread elements or cleats attached to an outsole of the sole portion.

Figure 18:
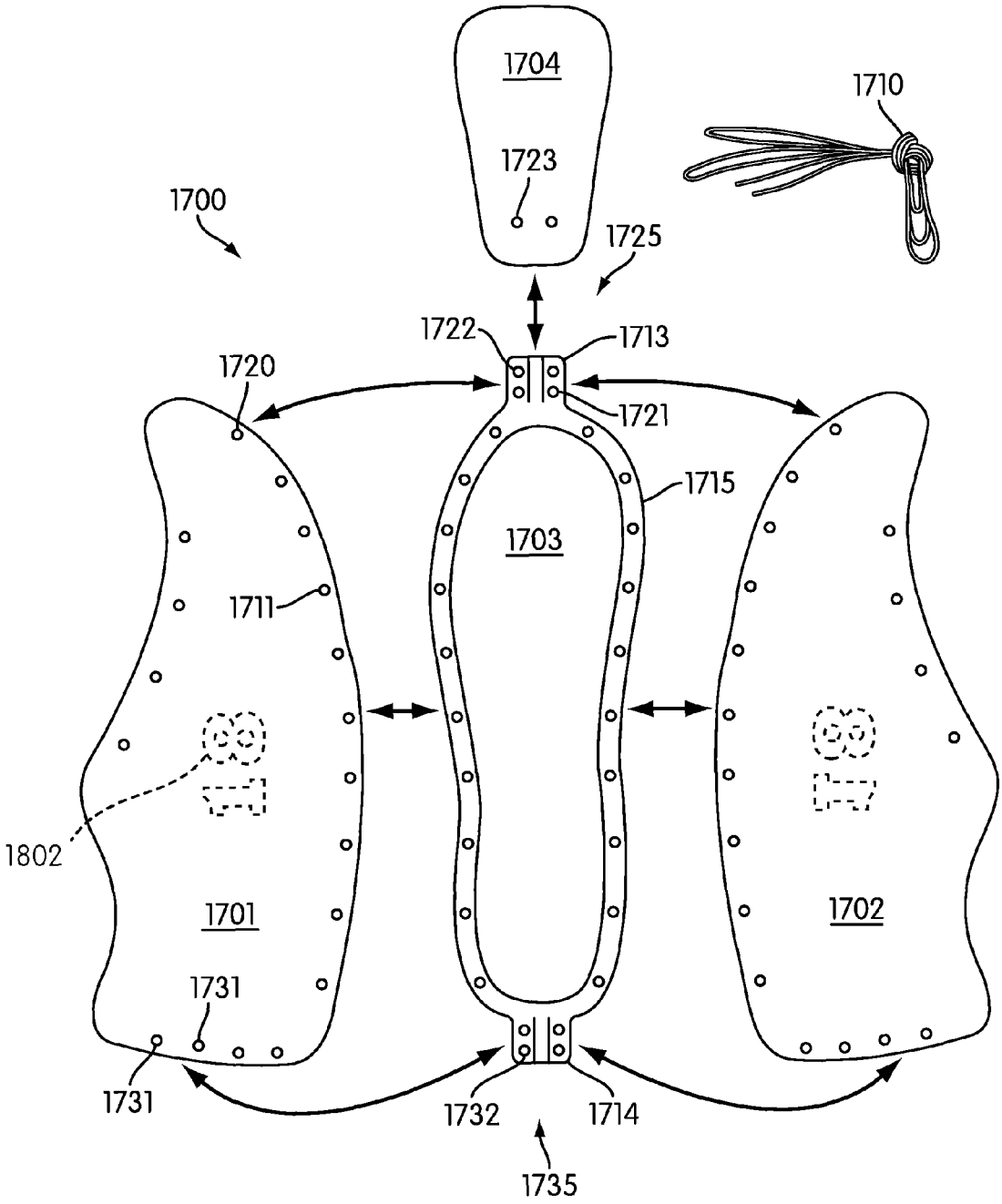
FIG. 18 is a preferred embodiment of pre-cut portions of an article of footwear.

Referring to FIG. 18, article of footwear 1700 may be associated with multiple pre-cut portions in addition to sole portion 1703. In this embodiment, article of footwear 1700 includes first pre-cut portion 1701 and second pre-cut portion 1702. In this case, pre-cut portions 1701 and 1702 may be side portions. Additionally, article of footwear 1700 may be associated with third pre-cut portion 1704. In this case, third pre-cut portion 1704 may be a tongue portion.

In the current embodiment, article of footwear 1700 may be a shoe for a child. In some cases, article of footwear 1700 may preferably be an athletic shoe for a child. In this case, custom design 1802 has been applied to pre-cut portions 1701 and 1702. Custom design 1802 may be applied using any of the provisions discussed in the previous embodiments for applying custom designs to one or more pre-cut portions. In other embodiments, other custom designs could also be applied to one or more pre-cut portions using a graphical interface system as discussed previously. Preferably, any type of custom design may be applied, and the types of designs that are applied are not limited to designs discussed in the previous embodiment of a baby bootie. Further examples of custom designs can be found in the customization case. With this arrangement, an article of footwear may be decorated for baby shoes, shoes for children, shoes for adults and other types of shoes.

In this current embodiment, portions 1701-1704 may assembled in a similar manner as discussed in the previous embodiment illustrated in FIG. 10. In some embodiments, lace 1710 may be stitched through holes 1711 of portions 1701-1704 to assemble article of footwear 1700. The current embodiment discusses a preferred method of assembling portions 1701-1704 using lace 1710, however, in other embodiment, different methods of assembling portions 1701-1704 with lace 1710 may be used as well. In this preferred embodiment, first pre-cut portion 1701 and second pre-cut portion 1702 may be fastened to sole portion 1703 by stitching lace 1710 through holes 1711 as mentioned in the discussion of FIG. 10.

Preferably, a toe region may be formed from portions 1701-1704. In some cases, first set of holes 1720 at forward end 1725 of first and second pre-cut portions 1701 and 1702 may be stitched to second set of holes 1721 of front flap 1713. Also, third set of holes 1722 of front flap 1713 may be stitched to fourth set of holes 1723 of third pre-cut portion 1704. This configuration preferably forms a toe region at forward end 1725 from portions 1701-1704.

Preferably, a heel region may be formed from portions 1701-1703. In some cases, first pre-cut portion 1701 and second pre-cut portion 1702 may include fifth set of holes 1731 at rearward end 1735. Additionally, rear flap 1714 may include sixth set of holes 1732. Fifth set of holes 1731 of pre-cut portions 1701 and 1702 may be stitched with lace 1710 to sixth set of holes 1732 of rear flap 1714. Using this arrangement, a heel region may be formed at rearward end 1735 of article of footwear 1700.

As discussed in the previous embodiments, a customer may stitch portions 1701-1704 together according to a set of instructions included in a kit of parts. Generally, any kind of stitching may be used to accomplish the attachment of portions 1701-1704 to one another. In other embodiments, portions 1701-1704 may not include pre-configured holes. Instead, pre-cut portions 1701-1704 may be stitched together using thinner laces that may penetrate portions 1701-1704. This alternative embodiment may allow for increased variety in stitching techniques, which may appeal to some customers.

Figure 19:
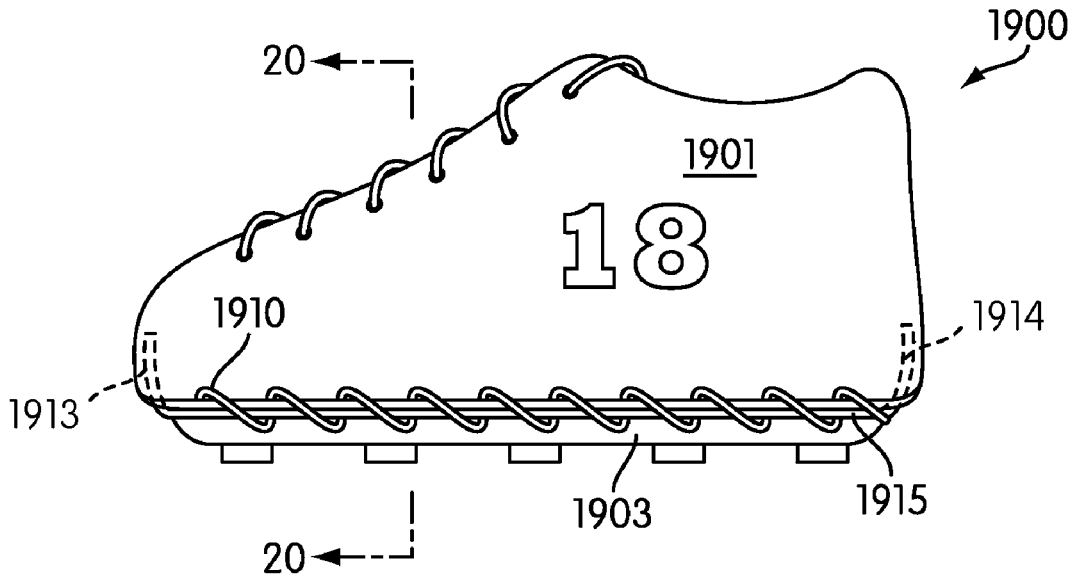
FIG. 19 is a side view of a preferred embodiment of an article of footwear.
Figure 20:
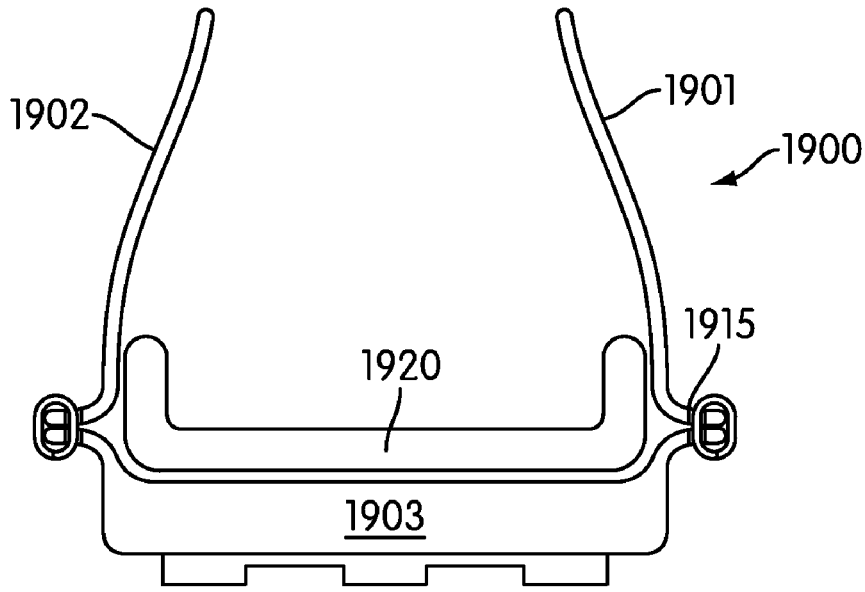
FIG. 20 is a cross sectional view of a preferred embodiment of an article of footwear.

FIGS. 19 and 20 are schematic views a preferred embodiment of an assembled article of footwear 1900. In this embodiment, first pre-cut portion 1901 has been attached to sole portion 1903 using lace 1910. In particular, lace 1910 is preferably stitched through side flaps 1915 of sole portion 1903. Additionally, lace 1910 may be stitched through front flap 1913 and rear flap 1914. In the current embodiment, flaps 1913 and 1914 are disposed on an interior side of article of footwear 1900. However, in other embodiments, flaps 1913 and 1914 could be disposed on an outer side of article of footwear 1900. By stitching lace 1910 through flaps 1913-1915, sole portion 1903 may be securely fastened to other pre-cut portions.

In some embodiments, an article of footwear may include provisions to increase comfort for a foot and prevent chaffing or rubbing against an interior of the article. In some cases, a liner may be included in article of footwear 1900. In the preferred embodiment illustrated in FIG. 20, liner 1920 is fitted over sole portion 1903 and partially covers first pre-cut portion 1901 and second pre-cut portion 1902. For illustrative purposes, the thickness of liner 1920 is exaggerated in the current embodiment. In other embodiments, the thickness of liner 1920 may be less than the thickness of a pre-cut portion associated with article of footwear 1900. With this arrangement, liner 1920 preferably covers the region where the bottom of a foot would fit in article of footwear 1900. By providing a continuous smooth surface, liner 1920 may prevent potential rubbing on a bottom of a foot where portions 1901-1903 are stitched together.

In some embodiments, liner 1920 may be a disposable shoe liner. In other embodiments, liner 1920 may be a permanent but removable shoe liner. In this preferred embodiment, liner 1920 may be a permanent shoe liner constructed of a thermoplastic polymer. Generally, liner 1920 may be constructed of any suitable material.

Generally, the various components associated with an article of footwear and discussed in the previous embodiments may be included in a kit of parts or purchased separately. For example, a customer may choose additional components such as a liner or lace locks when the customer makes the initial purchase of a pair of articles of footwear from a retailer. In this case, the additional components selected may be included in a kit of parts for the assembly of a pair of articles of footwear. In other cases, a customer may choose to purchase additional components such as crimped laces or a midsole for a pair of self assembled articles of footwear at a later time after the initial purchase.

Accordingly, various embodiments of the present invention allow a customer to customize the design as well as choose a type of support for a pair of self assembled articles of footwear. A customer may add a liner or midsole or both to a sole portion to increase comfort and add more support. In addition, a self assembled article of footwear may include a sole portion to increase the traction for a wearer. Thus, the present invention provides a customized experience by allowing a customer to customize and design a self assembled article of footwear and choose associated components.

While various embodiments of the invention have been described, the description is intended to be exemplary, rather than limiting and it will be apparent to those of ordinary skill in the art that many more embodiments and implementations are possible that are within the scope of the invention. Accordingly, the invention is not to be restricted except in light of the attached claims and their equivalents. Also, various modifications and changes may be made within the scope of the attached claims.

We claim:

1. A method of customizing an article of footwear, comprising the steps of:

providing a graphical interface system for designing a footwear representation;

receiving a design including a footwear representation with a customized design;

receiving a selected medium from a list of types of mediums to be used to apply the customized design;

using the selected medium to apply the customized design to one of a lateral side portion and a medial side portion according to the footwear representation;

providing a kit including the lateral side portion, the medial side portion, a sole portion, a lace, and a set of instructions for assembling the article of footwear; and wherein the lateral side portion, the medial side portion, and the sole portion are configured to be attached using the lace to assemble an article of footwear according to the set of instructions and wherein the lateral side portion and the medial side portion both include a plurality of lacing holes configured to receive the lace to be used to adjustably tighten the assembled article of footwear between an open position and a closed position, the lateral side portion and the medial side portion being pulled closer together by the lace in the closed position than in the open position.

2. The method according to claim 1, wherein the sole portion includes a front flap extending from a forward end of the sole portion and a rear flap extending from a rearward end of the sole portion.

3. The method according to claim 2, wherein the kit further includes a tongue portion configured to be attached by the lace to the front flap.

4. The method according to claim 1, wherein the selected medium includes digital printing and the customized design is digitally printed to one of the lateral side portion and the medial side portion.

5. The method according to claim 1, wherein the selected medium includes stitching and the customized design is stitched onto one of the lateral side portion and the medial side portion.

6. A kit of parts, comprising:

a lateral side portion, a medial side portion, and a sole portion, wherein at least one of the lateral side portion and medial side portion includes a customized design;

a lace;

a set of instructions; and wherein the lateral side portion, the medial side portion, and the sole portion are configured to be attached using the lace to assemble an article of footwear according to the set of instructions and wherein the lateral side portion and the medial side portion both include a plurality of lacing holes configured to receive the lace to be used to adjustably tighten the assembled article of footwear between an open position and a closed position, the lateral side portion and the medial side portion being pulled closer together by the lace in the closed position than in the open position.

7. The kit of parts according to claim 6, wherein the sole portion includes a front flap extending from a forward end of the sole portion and a rear flap extending from a rearward end of the sole portion.

8. The kit of parts according to claim 7, wherein the front flap is configured to be attached by the lace to both a forward end of the lateral side portion and a forward end of the medial side portion.

9. The kit of parts according to claim 7, wherein the kit of parts includes a tongue portion configured to be to be attached by the lace to the front flap.

10. The kit of parts according to claim 7, wherein the kit of parts includes a tongue portion configured to be to be attached by the lace to both a forward end of the lateral side portion and a forward end of the medial side portion.

11. The kit of parts according to claim 9, wherein the kit of parts includes a tongue portion configured to be to be attached by the lace to the both a forward end of the lateral side portion and a forward end of the medial side portion.

12. The kit of parts according to claim 6, wherein the lace includes a first end portion and a second end portion that are used to adjustably tighten the assembled article of footwear between the open position and the closed position.

13. The kit of parts according to claim 12, wherein the lace includes an intermediate portion that is disposed between the first end portion and the second end portion and wherein the intermediate portion is used to attach the lateral side portion to the medial side portion.

14. The kit of parts according to claim 6, wherein both the lateral side portion and the medial side portion include a customized design.

15. An article of footwear, comprising:

a lateral side portion, a medial side portion, and a bottom portion;

a lace including a first end portion, a second end portion, and an intermediate portion that is disposed between the first end portion and the second end portion;

the intermediate portion of the lace being used to attach together the lateral side portion, the medial side portion, and the sole portion;

wherein the first end portion and the second end portion are used to adjustably tighten the article of footwear between an open position and a closed position, the lateral side portion and the medial side portion being pulled closer together by both the first end portion and the second end portion in the closed position than in the open position; and the lateral side portion and the medial side portion both including a plurality of lacing holes configured to receive the lace to pull the lateral side portion and the medial side portion closer together in the closed position.

16. The article of footwear according to claim 15, wherein the lateral side portion and the medial side portion are both configured to overlap at a forward end of the article of footwear.

17. The article of footwear according to claim 16, further comprising a tongue portion, wherein the intermediate portion is used to attach both the lateral side portion and the medial side portion to the tongue portion.

18. The article of footwear according to claim 15, wherein the lace is associated with a first lace lock that is configured to prevent the first end portion from slipping through a first lacing hole disposed adjacent the forward end of the article of footwear on one of the lateral side portion and the medial side portion.

19. The article of footwear according to claim 18, further comprising a second lace lock configured to prevent the second end portion from slipping through a second lacing hole disposed adjacent a forward end of the article of footwear on one of the lateral side portion and the medial side portion, the first lace lock and the second lace lock together causing the intermediate portion to hold the lateral side portion and the medial side portion together adjacent the forward end while allowing the first end portion and the second end portion to adjustably tighten the article of footwear in a vamp region.

20. The article of footwear according to claim 15, wherein the intermediate portion is used to attach the medial side portion to the lateral side portion at both a forward region and a rearward region.

21. The article of footwear according to claim 15, further comprising a midsole having a first fastening region, wherein one of the lateral side portion and the medial side portion includes at least one strip having a second fastening region configured to fasten to the first fastening region.

22. The article of footwear according to claim 21, wherein the first and second fastening regions include complimentary hook and loop fasteners.

23. The article of footwear according to claim 21, wherein the first and second fastening regions include snaps.

24. An article of footwear, comprising:

a first pre-cut portion and a sole portion including a front flap extending from a forward end of the sole portion and a rear flap extending from a rearward end of the sole portion;

a lace including a first end portion, a second end portion, and an intermediate portion that is disposed between the first end portion and the second end portion;

the intermediate portion being used to attach the pre-cut portion to sole portion; and wherein the lace is disposed through at least one hole in the front flap and at least one hole in the rear flap.

25. The article of footwear according to claim 24, wherein the sole portion includes a side flap disposed between the front flap and the rear flap.

26. The article of footwear according to claim 24, further comprising a tongue portion, wherein the lace is disposed through at least one hole in the tongue portion to attach the tongue portion to the front flap.

27. The article of footwear according to claim 24, wherein the lace is associated with a lace lock that is configured to prevent the first end portion from slipping through a lacing hole disposed on the first pre-cut portion adjacent the forward end of the sole.

28. The article of footwear according to claim 24, further comprising a second pre-cut portion, wherein the lace is disposed through at least one hole in the first pre-cut portion and at least one hole in the second pre-cut portion to attach both the first pre-cut portion and the second pre-cut portion to one of the front flap and the rear flap.

* * * * *